US007967509B2

(12) United States Patent
Turvey et al.

(10) Patent No.: US 7,967,509 B2
(45) Date of Patent: Jun. 28, 2011

(54) POUCH WITH A VALVE

(75) Inventors: Robert R. Turvey, Sanford, MI (US); Brian C. Dais, Saginaw, MI (US); James C. Pawloski, Bay City, MI (US); Daniel P. Zimmerman, Livonia, MI (US); Kelly M. Griffioen, Kalamazoo, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1047 days.

(21) Appl. No.: 11/818,592

(22) Filed: Jun. 15, 2007

(65) Prior Publication Data

US 2008/0310774 A1 Dec. 18, 2008

(51) Int. Cl.
*B65D 33/16* (2006.01)
*B65D 33/01* (2006.01)
*B65D 33/00* (2006.01)

(52) U.S. Cl. ..... 383/63; 383/100; 383/105

(58) Field of Classification Search ..... 383/63, 383/61.2, 100, 101, 102, 103, 64, 65, 59, 383/105

See application file for complete search history.

(56) References Cited

U.S. PATENT DOCUMENTS

| | | | |
|---|---|---|---|
| 303,014 | A | 8/1884 | Hoyt |
| 1,187,031 | A | 6/1916 | Black et al. |
| 1,234,130 | A | 7/1917 | Cartwright |
| 1,572,190 | A | 2/1926 | Don |
| 1,621,132 | A | 3/1927 | Reinbold |
| 1,647,818 | A | 11/1927 | Semak |
| 2,024,367 | A | 12/1935 | Eriksson-Jons |
| 2,049,872 | A | 8/1936 | Sera |
| 2,184,732 | A | 12/1939 | Brewer |
| 2,226,145 | A | 12/1940 | Smith |
| 2,465,554 | A | 3/1949 | Roy |
| 2,576,322 | A | 11/1951 | Waters |
| 2,593,328 | A | 4/1952 | Meaker |
| 2,609,314 | A | 9/1952 | Engel et al. |
| 2,629,539 | A | 2/1953 | Drewes, Jr. |
| 2,633,442 | A | 3/1953 | Caldwell |
| 2,635,550 | A | 4/1953 | Granberg |
| 2,636,657 | A | 4/1953 | Lauritzen |
| 2,642,372 | A | 6/1953 | Chittick |
| 2,648,474 | A | 8/1953 | Crook |
| 2,669,176 | A | 2/1954 | Lazerus |

(Continued)

FOREIGN PATENT DOCUMENTS

| | | |
|---|---|---|
| CA | 1315746 | 4/1993 |

(Continued)

*Primary Examiner* — Jes F Pascua

(57) ABSTRACT

A pouch with a valve includes first and second pouch sidewalls sealed to one another to define an opening. A resealable closure mechanism is attached to inner surfaces of the first and second sidewalls proximate the opening to define a pouch interior opposite the opening. A channel extends from the interior to the opening between a section of the first closure element and the first sidewall. A pleated thermoplastic member is sealingly disposed in the channel and has an aperture disposed through the member. A fluid path may provide direct fluid communication between the interior and an exterior of the pouch, wherein the fluid path passes through an edge of the pouch defined by at least one of the first or second pouch sidewalls. A valve is sealingly disposed in the fluid path, wherein the valve comprises a pleated thermoplastic member attached to at least one of the first or second pouch sidewalls and having an aperture disposed through the pleated thermoplastic member to provide fluid communication between the interior and the exterior of the pouch.

15 Claims, 12 Drawing Sheets

U.S. PATENT DOCUMENTS

| | | | |
|---|---|---|---|
| 2,670,501 | A | 3/1954 | Michiels |
| 2,695,741 | A | 11/1954 | Haley |
| 2,759,866 | A | 8/1956 | Seymour |
| 2,772,712 | A | 12/1956 | Post |
| 2,776,452 | A | 1/1957 | Chavannes |
| 2,778,171 | A | 1/1957 | Taunton |
| 2,778,173 | A | 1/1957 | Taunton |
| 2,821,338 | A | 1/1958 | Metzger |
| 2,856,323 | A | 10/1958 | Gordon |
| 2,858,247 | A | 10/1958 | De Swart |
| 2,870,954 | A | 1/1959 | Kulesza |
| 2,913,030 | A | 11/1959 | Fisher |
| 2,916,411 | A | 12/1959 | Villoresi |
| 2,927,722 | A | 3/1960 | Metzger |
| 2,941,252 | A | 6/1960 | Bovenkerk |
| 2,960,144 | A | 11/1960 | Graf |
| 3,026,231 | A | 3/1962 | Chavannes |
| 3,060,985 | A | 10/1962 | Vance et al. |
| 3,077,428 | A | 2/1963 | Heuser et al. |
| 3,098,563 | A | 7/1963 | Skees |
| 3,102,676 | A | 9/1963 | Danelli et al. |
| 3,113,715 | A | 12/1963 | Pangrac |
| 3,135,411 | A | 6/1964 | Osborne |
| 3,141,221 | A | 7/1964 | Faulls, Jr. |
| 3,142,599 | A | 7/1964 | Chavannes |
| 3,149,772 | A | 9/1964 | Olsson |
| 3,160,323 | A | 12/1964 | Weisberg |
| 3,216,172 | A | 11/1965 | Piazze |
| 3,219,084 | A | 11/1965 | Ausnit et al. |
| 3,224,574 | A | 12/1965 | McConnell |
| 3,237,844 | A | 3/1966 | Hughes |
| 3,243,100 | A | 3/1966 | Adams |
| 3,251,463 | A | 5/1966 | Bodet |
| 3,302,859 | A | 2/1967 | Perry |
| 3,312,256 | A | 4/1967 | Reisinger |
| 3,325,084 | A | 6/1967 | Ausnit |
| 3,334,628 | A | 8/1967 | Saemann et al. |
| 3,372,442 | A | 3/1968 | Ishimatsu |
| 3,381,887 | A | 5/1968 | Lowry |
| 3,389,733 | A | 6/1968 | Siegel |
| 3,405,710 | A | 10/1968 | Kovach |
| 3,411,698 | A | 11/1968 | Reynolds |
| 3,423,231 | A | 1/1969 | Lutzmann |
| 3,440,696 | A | 4/1969 | Staller |
| 3,464,094 | A | 9/1969 | Mates |
| 3,516,217 | A | 6/1970 | Gildersleeve |
| 3,557,413 | A | 1/1971 | Engle |
| 3,565,147 | A | 2/1971 | Ausnit |
| 3,575,781 | A | 4/1971 | Pezely |
| 3,595,467 | A | 7/1971 | Goglio |
| 3,595,722 | A | 7/1971 | Dawbarn |
| 3,595,740 | A | 7/1971 | Gerow |
| 3,600,267 | A | 8/1971 | McFedries, Jr. et al. |
| 3,608,439 | A | 9/1971 | Ausnit |
| 3,628,576 | A | 12/1971 | Owen |
| 3,628,720 | A | 12/1971 | Schmedding |
| 3,633,642 | A | 1/1972 | Siegel |
| 3,655,501 | A | 4/1972 | Tesch |
| 3,661,677 | A | 5/1972 | Wang |
| 3,679,511 | A | 7/1972 | Ausnit |
| 3,703,170 | A | 11/1972 | Ryckman, Jr. |
| 3,746,215 | A | 7/1973 | Ausnit et al. |
| 3,762,404 | A | 10/1973 | Sakita |
| 3,780,781 | A | 12/1973 | Uramoto |
| 3,790,992 | A | 2/1974 | Herz |
| 3,799,427 | A | 3/1974 | Goglio |
| 3,800,786 | A | 4/1974 | Kovach |
| 3,809,217 | A | 5/1974 | Harrison |
| 3,811,432 | A | 5/1974 | Moret |
| 3,828,520 | A | 8/1974 | Merritt |
| 3,833,166 | A | 9/1974 | Murray |
| 3,834,118 | A | 9/1974 | Waldrop et al. |
| 3,908,070 | A | 9/1975 | Marzolf |
| 3,918,131 | A | 11/1975 | Ausnit |
| 3,937,396 | A | 2/1976 | Schneider |
| 3,958,391 | A | 5/1976 | Kujubu |
| 3,977,084 | A | 8/1976 | Sloan |
| 3,980,226 | A | 9/1976 | Franz |
| 3,989,182 | A | 11/1976 | Stearley |
| 4,000,846 | A | 1/1977 | Gilbert |
| 4,018,253 | A | 4/1977 | Kaufman |
| 4,020,884 | A | 5/1977 | Jadot |
| 4,033,511 | A | 7/1977 | Chamberlin |
| 4,051,971 | A | 10/1977 | Saleri et al. |
| RE29,524 | E | 1/1978 | Spencer |
| 4,072,210 | A | 2/1978 | Chien |
| 4,080,105 | A | 3/1978 | Connell |
| 4,085,886 | A | 4/1978 | Nishioka |
| 4,101,355 | A | 7/1978 | Ausnit |
| 4,104,404 | A | 8/1978 | Bieler et al. |
| 4,105,491 | A | 8/1978 | Haase et al. |
| 4,122,993 | A | 10/1978 | Glas |
| 4,134,535 | A | 1/1979 | Barthels et al. |
| 4,155,453 | A | 5/1979 | Ono |
| 4,164,111 | A | 8/1979 | Di Bernardo |
| 4,186,786 | A | 2/1980 | Kirkpatrick |
| 4,206,870 | A | 6/1980 | DeVries |
| 4,212,337 | A | 7/1980 | Kamp |
| 4,215,725 | A | 8/1980 | Callet et al. |
| 4,246,288 | A | 1/1981 | Sanborn, Jr. |
| 4,249,583 | A | 2/1981 | Lundbladh |
| 4,267,960 | A | 5/1981 | Lind et al. |
| 4,273,120 | A | 6/1981 | Oswell |
| 4,278,114 | A | 7/1981 | Ruberg |
| 4,287,819 | A | 9/1981 | Emerit |
| 4,307,730 | A | 12/1981 | Korn |
| 4,310,118 | A | 1/1982 | Kisida et al. |
| 4,332,344 | A | 6/1982 | Strodthoff |
| 4,337,804 | A | 7/1982 | Maruscak |
| 4,340,558 | A | 7/1982 | Hendrickson |
| 4,341,235 | A | 7/1982 | Nord |
| 4,354,541 | A | 10/1982 | Tilman |
| 4,355,494 | A | 10/1982 | Tilman |
| 4,357,730 | A | 11/1982 | Lex |
| 4,362,095 | A | 12/1982 | Wheatley |
| 4,363,345 | A | 12/1982 | Scheibner |
| 4,364,989 | A | 12/1982 | Moyle |
| 4,370,187 | A | 1/1983 | Katagiri et al. |
| 4,372,921 | A | 2/1983 | Sanderson et al. |
| 4,389,166 | A | 6/1983 | Harvey et al. |
| 4,403,233 | A | 9/1983 | Terasawa et al. |
| 4,426,816 | A | 1/1984 | Dean et al. |
| 4,430,070 | A | 2/1984 | Ausnit |
| 4,433,574 | A | 2/1984 | Williams et al. |
| 4,449,243 | A | 5/1984 | Platel |
| 4,470,153 | A | 9/1984 | Kenan |
| 4,491,959 | A | 1/1985 | Loefberg |
| 4,509,642 | A | 4/1985 | Rowell |
| 4,519,755 | A | 5/1985 | Hanson |
| 4,524,460 | A | 6/1985 | Twiehoff et al. |
| 4,528,224 | A | 7/1985 | Ausnit |
| 4,532,652 | A | 7/1985 | Herrington |
| 4,541,117 | A | 9/1985 | Ashbeck |
| 4,550,546 | A | 11/1985 | Raley et al. |
| 4,551,379 | A | 11/1985 | Kerr |
| 4,561,699 | A | 12/1985 | Adachi et al. |
| 4,566,131 | A | 1/1986 | Achelpohl |
| 4,569,712 | A | 2/1986 | Shibano et al. |
| 4,573,441 | A | 3/1986 | Wietschorke et al. |
| 4,576,283 | A | 3/1986 | Fafournoux |
| 4,576,285 | A | 3/1986 | Goglio |
| 4,578,813 | A | 3/1986 | Ausnit |
| 4,579,096 | A | 4/1986 | Kobayashi et al. |
| 4,579,784 | A | 4/1986 | Lemstra et al. |
| 4,581,764 | A | 4/1986 | Plock et al. |
| 4,583,347 | A | 4/1986 | Nielsen |
| 4,583,925 | A | 4/1986 | Hawkins |
| 4,612,221 | A | 9/1986 | Biel et al. |
| 4,614,479 | A | 9/1986 | Liu |
| 4,615,361 | A | 10/1986 | Bartle, Sr. |
| 4,627,796 | A | 12/1986 | Moore |
| 4,653,661 | A | 3/1987 | Buchner et al. |
| 4,656,687 | A | 4/1987 | Wei |
| 4,658,433 | A | 4/1987 | Savicki |
| 4,658,434 | A | 4/1987 | Murray |
| 4,660,355 | A | 4/1987 | Kristen |
| 4,672,684 | A | 6/1987 | Barnes et al. |

4,683,702 A 8/1987 Vis
4,691,372 A 9/1987 Van Erden
4,691,373 A 9/1987 Ausnit
4,701,358 A 10/1987 Behr et al.
4,702,376 A 10/1987 Pagliaro
4,705,174 A 11/1987 Goglio
4,712,574 A 12/1987 Perrott
4,712,983 A 12/1987 Moynihan
4,715,494 A 12/1987 Heitzenröder et al.
4,730,635 A 3/1988 Linden
4,731,911 A 3/1988 Gould
4,736,450 A 4/1988 Van Erden et al.
4,736,451 A 4/1988 Ausnit
4,745,730 A 5/1988 Bartle, Sr.
4,747,702 A 5/1988 Scheibner
4,752,992 A 6/1988 Kondo et al.
4,756,422 A 7/1988 Kristen
4,756,628 A 7/1988 Branson
4,756,629 A 7/1988 Tilman et al.
4,763,803 A 8/1988 Schneider
4,778,282 A 10/1988 Borchardt et al.
4,780,937 A 11/1988 Kusayama
4,782,951 A 11/1988 Griesbach et al.
4,784,885 A 11/1988 Carespodi
4,787,754 A 11/1988 Herrington
4,787,755 A 11/1988 Branson
4,787,880 A 11/1988 Ausnit
4,791,710 A 12/1988 Nocek et al.
4,792,240 A 12/1988 Ausnit
4,795,269 A 1/1989 Scheibner
4,796,300 A 1/1989 Branson
4,807,300 A 2/1989 Ausnit et al.
4,808,010 A 2/1989 Vogan
4,812,056 A 3/1989 Zieke
4,812,074 A 3/1989 Ausnit et al.
4,817,188 A 3/1989 Van Erden
4,817,230 A 4/1989 Kiyooka
4,825,514 A 5/1989 Akeno
4,829,641 A 5/1989 Williams
4,832,096 A 5/1989 Kohlbach
4,832,505 A 5/1989 Ausnit et al.
4,834,554 A 5/1989 Stetler, Jr. et al.
4,840,611 A 6/1989 Van Erden et al.
4,841,603 A 6/1989 Ragni
4,854,733 A 8/1989 Schwinn
4,858,286 A 8/1989 Siegel
4,859,259 A 8/1989 Scheibner
4,861,632 A 8/1989 Caggiano
4,863,286 A 9/1989 Branson
4,869,725 A 9/1989 Schneider et al.
D303,856 S 10/1989 Yuen
4,874,033 A 10/1989 Nicholas Marchiani Chatelain
4,875,259 A 10/1989 Appeldorn
4,875,832 A 10/1989 Suzuki et al.
4,877,334 A 10/1989 Cope
4,877,336 A 10/1989 Peppiatt
4,878,763 A 11/1989 Ausnit
4,880,091 A 11/1989 Hasegawa et al.
4,890,517 A 1/1990 Ueki et al.
4,890,637 A 1/1990 Lamparter
4,890,935 A 1/1990 Ausnit et al.
4,892,414 A 1/1990 Ausnit
4,898,477 A 2/1990 Cox et al.
4,903,718 A 2/1990 Sullivan
4,907,321 A 3/1990 Williams
4,909,017 A 3/1990 McMahon et al.
4,911,960 A 3/1990 Mudge et al.
4,923,701 A 5/1990 VanErden
4,925,318 A 5/1990 Sorenson
4,928,829 A 5/1990 Di Bernardo
4,929,487 A 5/1990 Tilman et al.
4,930,904 A 6/1990 Gröner et al.
4,937,139 A 6/1990 Genske et al.
4,941,307 A 7/1990 Wojcik
4,941,310 A 7/1990 Kristen
4,947,525 A 8/1990 Van Erden
4,953,708 A 9/1990 Beer et al.
4,961,944 A 10/1990 Matoba et al.
4,964,739 A 10/1990 Branson et al.
4,965,108 A 10/1990 Biel et al.
4,966,470 A 10/1990 Thompson et al.
4,971,845 A 11/1990 Aaker et al.
4,975,028 A 12/1990 Schultz
4,984,611 A 1/1991 Takatsuki et al.
4,985,192 A 1/1991 Roeder et al.
4,989,292 A 2/1991 Hwang
4,989,745 A 2/1991 Schneider
5,000,500 A 3/1991 Almog
D316,316 S 4/1991 Yuen
5,007,143 A 4/1991 Herrington
5,009,236 A 4/1991 Brothers
5,009,318 A 4/1991 Lepinoy
5,012,561 A 5/1991 Porchia et al.
5,017,021 A 5/1991 Simonsen et al.
5,022,530 A 6/1991 Zieke
5,031,785 A 7/1991 Lemme
5,033,868 A 7/1991 Peppiatt
RE33,674 E 8/1991 Uramoto
5,037,138 A 8/1991 McClintock et al.
5,041,316 A 8/1991 Parnell et al.
5,044,774 A 9/1991 Bullard et al.
5,053,091 A 10/1991 Giljam et al.
5,056,933 A 10/1991 Kamp
5,059,036 A 10/1991 Richison et al.
5,067,208 A 11/1991 Herrington, Jr. et al.
5,067,822 A 11/1991 Wirth et al.
5,069,962 A 12/1991 Okazaki et al.
5,070,584 A 12/1991 Dais et al.
5,088,162 A 2/1992 Allan
5,088,971 A 2/1992 Herrington
5,092,684 A 3/1992 Weeks
5,093,164 A 3/1992 Bauer et al.
5,093,188 A 3/1992 Dohrer
5,097,648 A 3/1992 Berner et al.
5,097,956 A 3/1992 Davis
5,112,138 A 5/1992 Peppiatt
5,119,531 A 6/1992 Berger et al.
5,120,586 A 6/1992 Nedzu et al.
5,121,590 A 6/1992 Scanlan
5,121,995 A 6/1992 Newman et al.
5,128,182 A 7/1992 Bunker et al.
5,131,121 A 7/1992 Herrington, Jr. et al.
5,134,001 A 7/1992 Osgood
5,140,727 A 8/1992 Dais et al.
5,140,796 A 8/1992 Pope
5,141,577 A 8/1992 Porchia et al.
5,142,970 A 9/1992 ErkenBrack
5,145,258 A 9/1992 Schneck et al.
5,161,286 A 11/1992 Herrington, Jr. et al.
5,167,454 A 12/1992 Woods et al.
5,168,586 A 12/1992 Small
5,170,990 A 12/1992 Kamiya et al.
5,174,658 A 12/1992 Cook et al.
5,177,332 A 1/1993 Fong
5,179,767 A 1/1993 Allan
5,183,076 A 2/1993 Guillin et al.
5,184,896 A 2/1993 Hammond et al.
5,186,543 A 2/1993 Cochran
5,188,461 A 2/1993 Sorenson
5,189,764 A 3/1993 Herrington et al.
5,192,135 A 3/1993 Woods et al.
5,195,427 A 3/1993 Germano
5,198,055 A 3/1993 Wirth et al.
5,203,458 A 4/1993 Cornwell
5,208,096 A 5/1993 Dohrer
5,209,264 A 5/1993 Koyanagi
5,209,574 A 5/1993 Tilman
5,209,972 A 5/1993 Super et al.
5,211,481 A 5/1993 Tilman
5,212,855 A 5/1993 McGanty
5,216,787 A 6/1993 Custer et al.
5,228,271 A 7/1993 Wallace
5,230,430 A 7/1993 Kidder
D338,399 S 8/1993 Conte, Jr.
5,236,384 A 8/1993 Fabricant et al.
5,236,749 A 8/1993 Ewing
5,238,306 A 8/1993 Heintz et al.
5,240,112 A 8/1993 Newburger 5,242,516 A 9/1993 Custer et al.
5,242,757 A 9/1993 Buisine et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,254,073 A 10/1993 Richison et al.
5,263,520 A 11/1993 Arai
5,263,777 A 11/1993 Domke
RE34,477 E 12/1993 Cornwell
5,272,794 A 12/1993 Hamatani et al.
5,283,932 A 2/1994 Richardson et al.
5,287,680 A 2/1994 Lau
RE34,554 E 3/1994 Ausnit
5,293,672 A 3/1994 Tominaga et al.
5,296,769 A 3/1994 Havens et al.
5,299,917 A 4/1994 Schultz
5,300,354 A 4/1994 Harita et al.
5,301,394 A 4/1994 Richardson et al.
5,301,395 A 4/1994 Richardson et al.
5,304,041 A 4/1994 Fontanazzi et al.
5,308,666 A 5/1994 Borchardt
5,316,263 A 5/1994 Mino
5,320,889 A 6/1994 Bettle, III
5,324,572 A 6/1994 Kuechler et al.
5,326,176 A 7/1994 Domke
5,328,149 A 7/1994 Reuter
5,332,095 A 7/1994 Wu
5,333,736 A 8/1994 Kawamura
5,338,166 A 8/1994 Schultz
5,339,602 A 8/1994 Landers et al.
5,339,959 A 8/1994 Cornwell
5,342,684 A 8/1994 Carespodi
5,346,312 A 9/1994 Mabry et al.
5,347,918 A 9/1994 Chen
5,351,369 A 10/1994 Swain
5,351,828 A 10/1994 Becker et al.
5,352,323 A 10/1994 Chi
5,354,133 A 10/1994 Rapparini
5,356,222 A 10/1994 Kettner et al.
5,360,670 A 11/1994 Yonezu et al.
5,362,168 A 11/1994 Abe et al.
5,362,351 A 11/1994 Karszes
5,364,241 A 11/1994 Schultz
5,366,294 A 11/1994 Wirth et al.
5,368,394 A 11/1994 Scott et al.
5,371,925 A 12/1994 Sawatsky
5,376,392 A 12/1994 Ikegami et al.
5,382,470 A 1/1995 Vicik
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,405,038 A 4/1995 Chuang
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,419,769 A 5/1995 Devlin et al.
5,433,136 A 7/1995 Lung-Po
5,435,864 A 7/1995 Machacek et al.
5,443,851 A 8/1995 Christie et al.
5,445,275 A 8/1995 Curley et al.
5,445,870 A 8/1995 Buchner et al.
5,448,807 A 9/1995 Herrington, Jr.
5,449,079 A 9/1995 Yang
5,450,963 A 9/1995 Carson
5,456,979 A 10/1995 Schirmer
5,462,473 A 10/1995 Sheller
5,465,857 A 11/1995 Yang
5,469,966 A 11/1995 Boyer
5,474,818 A 12/1995 Ulrich et al.
5,480,030 A 1/1996 Sweeney et al.
5,482,375 A 1/1996 Richardson et al.
5,492,241 A 2/1996 Barnett et al.
5,494,165 A 2/1996 Detrick
5,507,190 A 4/1996 Guttmann
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
D371,650 S 7/1996 Dingelstad
5,540,500 A 7/1996 Tanaka
5,540,557 A 7/1996 Carson
5,542,902 A 8/1996 Richison et al.
5,544,752 A 8/1996 Cox
5,545,419 A 8/1996 Brady et al.
5,549,944 A 8/1996 Abate
5,551,127 A 9/1996 May
5,553,942 A 9/1996 Domke et al.
5,554,423 A 9/1996 Abate
5,558,439 A 9/1996 Tilman
5,558,613 A 9/1996 Tilman et al.
5,564,480 A 10/1996 Chen
5,564,581 A 10/1996 Lin
5,566,429 A 10/1996 Martinez et al.
5,567,533 A 10/1996 Toney et al.
5,570,628 A 11/1996 Kiener et al.
5,573,614 A 11/1996 Tilman et al.
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,611,376 A 3/1997 Chuang
5,618,111 A 4/1997 Porchia et al.
5,622,431 A 4/1997 Simonsen
5,628,566 A 5/1997 Schreiter
5,638,664 A 6/1997 Levsen et al.
5,638,971 A 6/1997 Justesen
RE35,567 E 7/1997 Newsome
5,651,470 A 7/1997 Wu
5,653,251 A 8/1997 Handler
5,655,273 A 8/1997 Tomic et al.
5,655,357 A 8/1997 Kristen
5,655,842 A 8/1997 Hagino
5,655,890 A 8/1997 Liao
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,692,649 A 12/1997 Schwab
5,692,837 A 12/1997 Beer
5,693,283 A 12/1997 Fehn
5,699,838 A 12/1997 Catallo et al.
5,700,091 A 12/1997 Tanaka et al.
5,701,996 A 12/1997 Goto et al.
5,709,479 A 1/1998 Bell
5,709,915 A 1/1998 Tomic et al.
5,713,669 A 2/1998 Thomas et al.
5,716,138 A 2/1998 Southwell
5,718,024 A 2/1998 Robbins
5,720,550 A 2/1998 Akiyama et al.
5,727,742 A 3/1998 Lawson
5,729,876 A 3/1998 Johnson
5,730,919 A 3/1998 Wilfong et al.
5,733,619 A 3/1998 Patel et al.
5,735,317 A 4/1998 Wu
5,735,395 A 4/1998 Lo
5,749,493 A 5/1998 Boone et al.
5,749,658 A 5/1998 Kettner
5,753,895 A 5/1998 Olson et al.
5,765,608 A 6/1998 Kristen
5,765,708 A 6/1998 Fragos
5,769,472 A 6/1998 Small
5,769,772 A 6/1998 Wiley
5,770,287 A 6/1998 Miranda et al.
5,774,954 A 7/1998 Ramsey et al.
5,775,200 A 7/1998 Tsai
5,775,812 A 7/1998 St. Phillips et al.

5,779,082 A 7/1998 Miramon
5,782,562 A 7/1998 Anspacher
5,782,733 A 7/1998 Yeager
5,784,862 A 7/1998 Germano
5,786,010 A 7/1998 Yannuzzi, Jr.
5,791,783 A 8/1998 Porchia et al.
5,794,315 A 8/1998 Crabtree et al.
5,804,265 A 9/1998 Saad et al.
5,806,575 A 9/1998 Tsay
5,826,631 A 10/1998 Gold et al.
5,827,163 A 10/1998 Kettner
5,827,586 A 10/1998 Yamashita et al.
5,829,884 A 11/1998 Yeager
5,830,545 A 11/1998 Frisk
5,833,791 A 11/1998 Bryniarski et al.
5,839,582 A 11/1998 Strong et al.
5,839,831 A 11/1998 Mazzocchi
5,839,832 A 11/1998 Hagino
5,843,578 A 12/1998 Sasaki et al.
5,855,498 A 1/1999 Spector
5,871,281 A 2/1999 Stolmeier et al.
5,871,790 A 2/1999 Monier et al.
5,873,217 A 2/1999 Smith
5,874,155 A 2/1999 Gehrke et al.
5,875,611 A 3/1999 Plourde
5,881,590 A 3/1999 Small
5,881,881 A 3/1999 Carrington
5,881,883 A 3/1999 Siegelman
5,882,120 A 3/1999 Bell
5,893,461 A 4/1999 Walters
5,893,645 A 4/1999 May
5,893,822 A 4/1999 Deni et al.
5,894,707 A 4/1999 May
5,894,929 A 4/1999 Kai et al.
5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,919,547 A 7/1999 Kocher et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,965,224 A 10/1999 Chen et al.
5,965,235 A 10/1999 McGuire et al.
5,967,664 A 10/1999 Giles et al.
5,971,613 A 10/1999 Bell
5,981,028 A 11/1999 Sugawa et al.
5,983,466 A 11/1999 Petkovsek
5,985,391 A 11/1999 Denehy et al.
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,195 A 1/2000 Skaggs
6,017,412 A 1/2000 Van Erden et al.
6,019,512 A 2/2000 Yeager
6,021,624 A 2/2000 Richison et al.
6,023,914 A 2/2000 Richison et al.
6,024,220 A 2/2000 Smith et al.
6,029,810 A 2/2000 Chen
6,030,122 A 2/2000 Ramsey et al.
6,033,113 A 3/2000 Anderson
6,033,114 A 3/2000 Grimm et al.
6,039,182 A 3/2000 Light
6,044,621 A 4/2000 Malin et al.
6,045,264 A 4/2000 Miniea
6,045,546 A 4/2000 Drago et al.
6,045,648 A 4/2000 Palmgren et al.
6,047,450 A 4/2000 Machacek et al.
6,053,635 A 4/2000 Anderson et al.
6,056,439 A 5/2000 Graham
6,058,998 A 5/2000 Kristen
6,059,456 A 5/2000 May
6,059,457 A 5/2000 Spreche et al.
6,068,898 A 5/2000 Oyama
6,070,397 A 6/2000 Bachhuber
6,070,728 A 6/2000 Overby et al.
6,071,011 A 6/2000 Thomas et al.
6,071,626 A 6/2000 Frisk
6,074,096 A 6/2000 Tilman
6,076,967 A 6/2000 Beaudette
6,077,208 A 6/2000 Larkin et al.
6,077,578 A 6/2000 Valyi
6,080,252 A 6/2000 Plourde
6,082,897 A 7/2000 Galomb
6,083,584 A 7/2000 Smith et al.
6,085,906 A 7/2000 Lambert
6,085,922 A 7/2000 Esser
6,092,931 A 7/2000 Tilman
6,103,050 A 8/2000 Krueger
6,110,586 A 8/2000 Johnson
6,112,374 A 9/2000 Van Erden
6,116,781 A 9/2000 Skeens
6,117,505 A 9/2000 Weiss et al.
6,119,581 A 9/2000 Po
6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,146,764 A 11/2000 Suokas et al.
6,148,588 A 11/2000 Thomas et al.
6,149,302 A 11/2000 Taheri
6,149,304 A 11/2000 Hamilton et al.
6,152,601 A 11/2000 Johnson
6,156,363 A 12/2000 Chen et al.
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 2/2001 Marbler et al.
6,185,796 B1 2/2001 Ausnit
6,194,011 B1 2/2001 Glaser
6,194,043 B1 2/2001 Fehn
6,202,849 B1 3/2001 Graham
6,203,867 B1 3/2001 Derkach et al.
6,203,915 B1 3/2001 Prissok et al.
6,209,287 B1 4/2001 Thieman
6,216,314 B1 4/2001 Dangerfield
6,217,216 B1 4/2001 Taheri
6,218,024 B1 4/2001 Tamber et al.
6,220,754 B1 4/2001 Stiglic et al.
6,224,262 B1 5/2001 Hogan et al.
6,227,706 B1 5/2001 Tran
6,231,236 B1 5/2001 Tilman
6,231,975 B1 5/2001 Kong et al.
6,240,941 B1 6/2001 Small et al.
6,244,021 B1 6/2001 Ausnit et al.
6,244,748 B1 6/2001 Kasai et al.
6,248,442 B1 6/2001 Kong et al.

6,250,343 B1 6/2001 Chen
6,251,489 B1 6/2001 Weiss et al.
6,256,968 B1 7/2001 Kristen
6,257,763 B1 7/2001 Stolmeier et al.
6,270,257 B1 8/2001 Yeager
6,270,950 B1 8/2001 Bourdelais et al.
6,273,609 B1 8/2001 Johnson
6,274,181 B1 8/2001 Richison et al.
6,279,298 B1 8/2001 Thomas et al.
6,279,745 B1 8/2001 Huynen et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,294,264 B1 9/2001 Piper et al.
6,299,351 B1 10/2001 Warr
6,299,353 B1 10/2001 Piechocki et al.
6,299,720 B1 10/2001 Van Erden
6,303,199 B1 10/2001 Takada et al.
6,306,472 B1 10/2001 Buelow
6,316,114 B1 11/2001 Comer et al.
6,317,939 B1 11/2001 Malin
6,318,894 B1 11/2001 Derenthal
6,321,423 B1 11/2001 Johnson
6,334,711 B1 1/2002 Risgalla et al.
6,344,258 B1 2/2002 Rasmussen
6,345,911 B1 2/2002 Young et al.
6,347,437 B2 2/2002 Provan et al.
6,354,738 B1 3/2002 Buckman et al.
6,355,336 B1 3/2002 Wakabayashi et al.
6,357,915 B2 3/2002 Anderson
6,360,513 B1 3/2002 Strand et al.
6,361,209 B1 3/2002 LaRue et al.
6,361,211 B1 3/2002 Tilman
6,361,212 B1 3/2002 Sprehe et al.
6,361,843 B1 3/2002 Smith et al.
6,364,530 B1 4/2002 Buchman
6,367,976 B1 4/2002 Bannister
6,371,642 B1 4/2002 Nelson et al.
6,371,643 B2 4/2002 Saad et al.
6,371,644 B1 4/2002 Forman
6,372,359 B1 4/2002 Hayashi et al.
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,390,676 B1 5/2002 Colombo et al.
6,391,404 B1 5/2002 Rosenbaum et al.
6,402,375 B1 6/2002 Schreiter et al.
6,403,174 B1 6/2002 Copeta
6,408,872 B1 6/2002 Skeens et al.
6,412,669 B1 7/2002 Chuang
6,413,597 B1 7/2002 Hirai
6,439,771 B1 8/2002 Herrington, Jr.
6,443,191 B1 9/2002 Murayama et al.
6,450,686 B1 9/2002 May
6,451,426 B2 9/2002 Kong et al.
6,461,042 B1 10/2002 Tomic et al.
6,467,948 B1 10/2002 Lawson
6,468,332 B2 10/2002 Goglio et al.
6,479,115 B2 11/2002 Fehn
6,481,889 B2 11/2002 Delsahut
6,481,890 B1 11/2002 VandenHeuvel
6,487,758 B2 12/2002 Shaffer et al.
6,488,403 B2 12/2002 Lawson
6,489,022 B1 12/2002 Hamilton et al.
6,491,166 B1 12/2002 Compton et al.
6,491,433 B2 12/2002 Shabram, Jr. et al.
6,499,878 B1 12/2002 Dobreski et al.
6,499,879 B2 12/2002 Schneck
6,500,505 B2 12/2002 Piper et al.
6,503,588 B1 1/2003 Hayashi et al.
6,505,383 B2 1/2003 Machacek et al.
6,506,464 B1 1/2003 Montenieri et al.
6,513,659 B1 2/2003 Ogura et al.
6,517,242 B1 2/2003 Buchman
6,520,071 B1 2/2003 Lanza
6,521,312 B1 2/2003 Keiser
6,523,994 B2 2/2003 Lawson
6,524,002 B2 2/2003 Tomic
6,526,632 B1 3/2003 Blythe et al.
6,527,003 B1 3/2003 Webster
6,530,870 B2 3/2003 Buchman et al.
6,533,456 B1 3/2003 Buchman
D473,761 S 4/2003 Wilk et al.
6,539,594 B1 4/2003 Kasai et al.
6,550,223 B2 4/2003 Xiong et al.
6,550,965 B2 4/2003 Shaffer et al.
6,550,966 B1 4/2003 Saad et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,576,329 B2 6/2003 Kong
6,576,348 B2 6/2003 Eggers et al.
6,579,584 B1 6/2003 Compton
6,579,621 B1 6/2003 Shah
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,602,590 B2 8/2003 Ting et al.
6,604,634 B2 8/2003 Su
6,609,353 B1 8/2003 McMahon et al.
6,609,827 B2 8/2003 Bois et al.
6,609,828 B2 8/2003 Schneider et al.
6,611,996 B2 9/2003 Blythe et al.
6,620,474 B1 9/2003 Regnier et al.
6,622,857 B2 9/2003 Ohtsubo et al.
6,623,866 B2 9/2003 Migliorini et al.
6,626,092 B2 9/2003 Tarlow
6,632,021 B2 10/2003 Bois et al.
6,634,384 B2 10/2003 Skeens et al.
6,637,937 B2 10/2003 Bois
6,637,939 B2 10/2003 Huffer
6,648,615 B2 11/2003 Tsai
6,652,251 B1 11/2003 Chen
6,656,548 B1 12/2003 Beckwith et al.
6,659,643 B2 12/2003 Plourde et al.
6,662,827 B1 12/2003 Clougherty et al.
6,663,284 B2 12/2003 Buckingham et al.
6,663,947 B2 12/2003 Freedman et al.
6,666,355 B2 12/2003 Padar
6,666,580 B2 12/2003 Bois
6,667,083 B2 12/2003 Hayashi et al.
6,675,982 B2 1/2004 Heil et al.
6,679,027 B2 1/2004 Schreiter
6,680,104 B2 1/2004 Boris et al.
6,682,792 B2 1/2004 Schmal et al.
6,685,614 B1 2/2004 Arnell
6,691,383 B2 2/2004 Linton
6,692,147 B2 2/2004 Nelson
6,694,704 B1 2/2004 Ausnit
6,698,925 B2 3/2004 Bentsen
6,702,460 B1 3/2004 Geyer
6,706,377 B2 3/2004 Peet
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,732,874 B2 5/2004 Zilberman
6,739,755 B2 5/2004 Schreiter
6,740,019 B2 5/2004 Bois
6,753,370 B2 6/2004 Nakatsukasa et al.
6,755,568 B2 6/2004 Malone et al.
6,763,857 B2 7/2004 Brown
6,767,131 B2 7/2004 Taheri
6,770,006 B2 8/2004 Abrahamsen
6,772,666 B2 8/2004 Heil et al.
6,773,163 B2 8/2004 Ichikawa et al.

6,777,089 B1 8/2004 Königer et al.
6,780,146 B2 8/2004 Thomas et al.
6,786,641 B2 9/2004 Plourde
6,789,690 B2 9/2004 Nieh et al.
6,792,982 B2 9/2004 Lincoln et al.
6,794,021 B2 9/2004 Bader
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,820,391 B2 11/2004 Barmore et al.
6,821,099 B2 11/2004 Wilk et al.
6,821,589 B2 11/2004 Dobreski et al.
6,824,885 B2 11/2004 Fitch et al.
6,827,101 B2 12/2004 Tetreault et al.
6,827,105 B1 12/2004 Marble et al.
6,827,492 B2 12/2004 Cook
6,830,081 B1 12/2004 Chen
6,830,377 B2 12/2004 Schneider
6,833,170 B1 12/2004 Knoerzer et al.
6,835,257 B2 12/2004 Perrine
6,837,268 B2 1/2005 Skeens et al.
6,839,933 B2 1/2005 Wheeler et al.
6,845,598 B1 1/2005 Melchoir
6,846,107 B2 1/2005 Sweeney et al.
6,846,532 B1 1/2005 Bensur
6,846,551 B2 1/2005 Genske et al.
RE38,694 E 2/2005 Nelson
D501,859 S 2/2005 Presta
6,851,248 B2 2/2005 Knight et al.
6,854,886 B2 2/2005 Piechocki et al.
6,862,867 B2 3/2005 Cady et al.
6,862,980 B2 3/2005 Heil et al.
6,872,458 B1 3/2005 Rudd et al.
6,874,935 B2 4/2005 Edelman et al.
6,874,937 B2 4/2005 Ausnit
6,874,938 B2 4/2005 Price et al.
6,877,629 B2 4/2005 Meyer
6,877,898 B2 4/2005 Berich et al.
6,883,665 B1 4/2005 Ahn
6,884,207 B2 4/2005 Pokusa
6,884,483 B2 4/2005 Hayashi et al.
6,901,637 B2 6/2005 Machacek
6,902,046 B1 6/2005 Dumas
6,902,795 B1 6/2005 Ishii et al.
6,910,805 B2 6/2005 Johnson
6,910,806 B2 6/2005 Strand et al.
6,913,387 B2 7/2005 Strand et al.
6,913,388 B2 7/2005 Laske
6,923,574 B2 8/2005 Siegel
6,925,688 B1 8/2005 Savicki
6,929,127 B1 8/2005 Delk, Sr.
6,932,509 B2 8/2005 Shah et al.
6,939,042 B2 9/2005 Rusnak et al.
6,939,597 B2 9/2005 Winget et al.
6,945,392 B2 9/2005 Furukawa et al.
6,946,176 B2 9/2005 Jousse et al.
6,951,420 B1 10/2005 Leighton
6,954,969 B1 10/2005 Sprehe
6,955,465 B2 10/2005 Machacek et al.
6,957,915 B2 10/2005 Tankersley
D512,192 S 11/2005 Shim
6,960,374 B1 11/2005 Terada et al.
6,964,519 B2 11/2005 ErkenBrack
6,968,870 B1 11/2005 Tsay
6,971,417 B2 12/2005 Deni
6,974,256 B2 12/2005 Kinigakis et al.
6,976,669 B2 12/2005 Van Zijll Langhout et al.
6,979,495 B2 12/2005 Keung et al.
6,983,845 B2 1/2006 Shah et al.
6,984,278 B2 1/2006 Anderson et al.
6,988,828 B2 1/2006 Linneweil
6,990,790 B2 1/2006 Yasuhira
6,991,109 B1 1/2006 Shannon et al.
6,993,886 B2 2/2006 Johnson
6,996,879 B1 2/2006 Savicki
7,001,659 B2 2/2006 Iriyama
7,003,928 B2 2/2006 Patterson et al.
7,004,209 B2 2/2006 Davis et al.
7,004,632 B2 2/2006 Hamilton et al.
7,011,615 B2 3/2006 Price et al.
7,014,363 B2 3/2006 Hanson
7,021,027 B2 4/2006 Higer
7,021,034 B2 4/2006 Higer et al.
7,022,058 B2 4/2006 Lee
7,026,417 B2 4/2006 Yang et al.
7,036,988 B2 5/2006 Olechowski
7,040,356 B2 5/2006 Tarlow
7,045,190 B2 5/2006 Inagaki et al.
7,048,136 B2 5/2006 Havens et al.
7,051,762 B2 5/2006 Haamer
7,076,929 B2 7/2006 Patterson et al.
7,077,570 B2 7/2006 Fukumori et al.
7,077,923 B2 7/2006 Lin
D525,823 S 8/2006 Littmann
7,086,211 B2 8/2006 Bassett et al.
7,087,130 B2 8/2006 Wu et al.
7,087,277 B2 8/2006 Yang et al.
7,090,397 B2 8/2006 Stolmeier
7,090,398 B2 8/2006 Shibata
7,093,624 B2 8/2006 Chen
7,096,893 B2 8/2006 Vilalta et al.
7,097,359 B2 8/2006 Plourde et al.
7,104,290 B2 9/2006 Tseng
7,108,147 B2 9/2006 Cheung
7,114,931 B2 10/2006 Wilk et al.
7,121,433 B2 10/2006 Nelson et al.
7,127,875 B2 10/2006 Cheung
7,131,550 B2 11/2006 Vilalta et al.
7,138,025 B2 11/2006 Wu et al.
7,144,615 B2 12/2006 Peiffer et al.
7,157,126 B2 1/2007 Cosentino et al.
7,162,779 B2 1/2007 MacHacek
7,163,338 B2 1/2007 McCracken et al.
7,178,555 B2 2/2007 Engel et al.
7,197,860 B2 4/2007 Hughes et al.
7,197,861 B2 4/2007 Higer et al.
7,200,974 B2 4/2007 Higer et al.
7,204,067 B2 4/2007 Baptista
7,207,160 B2 4/2007 Baptista
7,244,223 B2 7/2007 Hartman et al.
7,246,555 B2 7/2007 Small et al.
D550,717 S 9/2007 Saunders et al.
D550,718 S 9/2007 Saunders et al.
7,270,479 B2 * 9/2007 Nelson ..... 383/63
7,437,805 B2 * 10/2008 Berich ..... 24/399
2001/0012550 A1 8/2001 Fehn
2001/0031371 A1 10/2001 Kong et al.
2001/0034999 A1 11/2001 Xiong et al.
2001/0038897 A1 11/2001 Curie et al.
2002/0012803 A1 1/2002 Kending
2002/0022144 A1 2/2002 Yang et al.
2002/0041964 A1 4/2002 Winget et al.
2002/0043052 A1 4/2002 Gyorffy
2002/0090151 A1 7/2002 Skeens et al.
2002/0097923 A1 7/2002 Dobreski et al.
2002/0124471 A1 9/2002 Anderson et al.
2002/0134046 A1 9/2002 Bois
2002/0146551 A1 10/2002 Freedman et al.
2002/0160167 A1 10/2002 Bader
2002/0168118 A1 11/2002 Price
2002/0168119 A1 11/2002 Herrington, Jr.
2002/0168489 A1 11/2002 Ting et al.
2002/0168512 A1 11/2002 Eggers et al.
2002/0182390 A1 12/2002 Migliorini et al.
2002/0187326 A1 12/2002 Kong
2002/0191872 A1 12/2002 Trani et al.
2003/0012901 A1 1/2003 Bezek et al.
2003/0016887 A1 1/2003 Su
2003/0021925 A1 1/2003 Schmal et al.
2003/0024847 A1 2/2003 Malaspina
2003/0031387 A1 2/2003 Gipson et al.
2003/0053722 A1 3/2003 Eggermont
2003/0059132 A1 3/2003 Vetter
2003/0066267 A1 * 4/2003 Nelson ..... 53/412
2003/0095727 A1 5/2003 Leighton
2003/0102245 A1 6/2003 Wang 2003/0116466 A1 6/2003 Goto
2003/0118253 A1 6/2003 Machacek
2003/0136798 A1 7/2003 Wilford
2003/0169948 A1 9/2003 Fenzl et al.
2003/0175457 A1 9/2003 Jousse et al.
2003/0207061 A1 11/2003 Hayashi et al.
2003/0219174 A1 11/2003 Piechocki
2003/0219177 A1 11/2003 Salvaro
2003/0219557 A1 11/2003 Denehy et al.
2003/0223654 A1 12/2003 Gerrits
2003/0228077 A1 12/2003 Laske
2003/0235669 A1 12/2003 Yang et al.
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0028856 A1 2/2004 Smith et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0058178 A1 3/2004 Yang et al.
2004/0078939 A1 4/2004 Pawloski
2004/0081375 A1 4/2004 Pokusa
2004/0091179 A1 5/2004 Anderson
2004/0091185 A1 5/2004 Shibata
2004/0091186 A1 5/2004 Shibata
2004/0098845 A1 5/2004 Fukumori et al.
2004/0105600 A1 6/2004 Floyd, Jr.
2004/0112458 A1 6/2004 Brown
2004/0114837 A1 6/2004 Koyanagi
2004/0135356 A1 7/2004 Katsuda et al.
2004/0136617 A1 7/2004 Gerrits
2004/0136618 A1 7/2004 Ausnit et al.
2004/0136622 A1 7/2004 Shigeta et al.
2004/0161175 A1 8/2004 Malone et al.
2004/0165794 A1 8/2004 Plourde et al.
2004/0177595 A1 9/2004 Kozak
2004/0191438 A1 9/2004 Cosentino et al.
2004/0208400 A1 10/2004 Linneweil
2004/0211698 A1 10/2004 John Mak
2004/0213967 A1 10/2004 Peiffer et al.
2004/0223667 A1 11/2004 Shah et al.
2004/0226458 A1 11/2004 Tarlow
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0013720 A1 1/2005 Wilk et al.
2005/0014011 A1 1/2005 Oya
2005/0022472 A1 2/2005 Brakes et al.
2005/0022473 A1 2/2005 Small et al.
2005/0022474 A1 2/2005 Albritton et al.
2005/0022480 A1 2/2005 Brakes
2005/0023179 A1 2/2005 Albritton
2005/0025394 A1 2/2005 Kinigakis et al.
2005/0028493 A1 2/2005 Small et al.
2005/0029152 A1 2/2005 Brakes et al.
2005/0029704 A1 2/2005 Wu et al.
2005/0034425 A1 2/2005 Johnson
2005/0034427 A1 2/2005 Higer et al.
2005/0034806 A1 2/2005 Wu et al.
2005/0034807 A1 2/2005 Wu et al.
2005/0035020 A1 2/2005 Wu et al.
2005/0035021 A1 2/2005 Higer et al.
2005/0036717 A1 2/2005 Wu et al.
2005/0036718 A1 2/2005 Wu et al.
2005/0036719 A1 2/2005 Wu et al.
2005/0037163 A1 2/2005 Wu et al.
2005/0037164 A1 2/2005 Wu et al.
2005/0039420 A1 2/2005 Albritton et al.
2005/0039421 A1 2/2005 Cheung
2005/0041889 A1 2/2005 Scarberry
2005/0041894 A1 2/2005 Hanson
2005/0042441 A1 2/2005 Peiffer et al.
2005/0042468 A1 2/2005 Peiffer et al.
2005/0043158 A1 2/2005 Wu et al.
2005/0061370 A1 3/2005 Higer et al.
2005/0061813 A1 3/2005 Vilalta et al.
2005/0063620 A1 3/2005 Anderson
2005/0065007 A1 3/2005 Wu et al.
2005/0069227 A1 3/2005 Steele
2005/0069229 A1 3/2005 McCracken et al.
2005/0081948 A1 4/2005 Deni
2005/0089250 A1 4/2005 Laske et al.
2005/0103798 A1 5/2005 Luigi
2005/0123748 A1 6/2005 Paris
2005/0135710 A1 6/2005 Melchoir
2005/0135945 A1 6/2005 Nelson et al.
2005/0147330 A1 7/2005 Lee
2005/0152623 A1 7/2005 Marley et al.
2005/0152624 A1 7/2005 Versluys
2005/0172577 A1 8/2005 Oltrogge
2005/0172834 A1 8/2005 Lee
2005/0175469 A1 8/2005 Lucchi
2005/0178691 A1* 8/2005 Frenkil ..... 206/524.8
2005/0190995 A1 9/2005 Koyanagi
2005/0196076 A1 9/2005 Tanaka et al.
2005/0196078 A1 9/2005 McKinney et al.
2005/0205455 A1 9/2005 Harrison
2005/0207679 A1* 9/2005 Armstrong ..... 383/64
2005/0208282 A1 9/2005 Woods, Jr. et al.
2005/0220373 A1 10/2005 Wu
2005/0220374 A1 10/2005 Thomas et al.
2005/0220376 A1 10/2005 Tsukanome et al.
2005/0229365 A1 10/2005 Offa-Jones
2005/0235468 A1 10/2005 Borchardt et al.
2005/0238263 A1 10/2005 Ping
2005/0244083 A1 11/2005 McMahon et al.
2005/0245376 A1 11/2005 Savicki et al.
2005/0251973 A1 11/2005 Sprehe
2005/0254731 A1 11/2005 Berbert et al.
2005/0259894 A1 11/2005 Swartz et al.
2005/0259895 A1 11/2005 Kozak
2005/0271308 A1 12/2005 Pawloski
2005/0276524 A1 12/2005 Taheri
2005/0281489 A1 12/2005 Yeh et al.
2005/0281490 A1 12/2005 Schneider et al.
2005/0281493 A1 12/2005 Heinemeier et al.
2005/0281494 A1 12/2005 Allen et al.
2005/0282695 A1 12/2005 Yeager
2005/0286808 A1 12/2005 Zimmerman et al.
2005/0286810 A1 12/2005 Sprague et al.
2005/0286811 A1 12/2005 Sprague et al.
2005/0286812 A1 12/2005 Sprague et al.
2005/0286813 A1 12/2005 Borchardt
2005/0286817 A1 12/2005 Hall et al.
2006/0008185 A1 1/2006 Borchardt
2006/0008187 A1 1/2006 Armstrong
2006/0013513 A1 1/2006 Meyer
2006/0013514 A1 1/2006 Wu
2006/0029299 A1 2/2006 Share et al.
2006/0030472 A1 2/2006 Hartman et al.
2006/0034551 A1 2/2006 Linneweil
2006/0035046 A1 2/2006 Lee
2006/0035777 A1 2/2006 Johnson
2006/0045390 A1 3/2006 Sill et al.
2006/0045392 A1 3/2006 Bannister et al.
2006/0048483 A1 3/2006 Tilman et al.
2006/0048486 A1 3/2006 Laing et al.
2006/0050999 A1 3/2006 Blythe et al.
2006/0053749 A1 3/2006 Scanlan
2006/0072860 A1 4/2006 Wu
2006/0073291 A1 4/2006 Wu
2006/0076058 A1 4/2006 Rypstra
2006/0093242 A1 5/2006 Anzini et al.
2006/0104548 A1 5/2006 Schreiter
2006/0105166 A1 5/2006 Lischefski et al.
2006/0110078 A1 5/2006 Sholzberg et al.
2006/0110079 A1 5/2006 Zimmerman et al.
2006/0111226 A1 5/2006 Anzini et al.
2006/0115187 A1 6/2006 Ausnit et al.
2006/0120632 A1 6/2006 Han
2006/0120633 A1 6/2006 Goldenberg et al.
2006/0131328 A1 6/2006 Anderson
2006/0157140 A1 7/2006 Bergman et al.

| | | | |
|---|---|---|---|
| 2006/0159372 | A1 | 7/2006 | Plourde et al. |
| 2006/0159576 | A1 | 7/2006 | Bergman et al. |
| 2006/0165316 | A1 | 7/2006 | Cheung |
| 2006/0172137 | A1 | 8/2006 | Champion |
| 2006/0177155 | A1 | 8/2006 | Owen |
| 2006/0177156 | A1 | 8/2006 | Owen et al. |
| 2006/0177158 | A1 | 8/2006 | Scholtis et al. |
| 2006/0179620 | A1 | 8/2006 | MacHacek |
| 2006/0182371 | A1 | 8/2006 | Borchardt |
| 2006/0193540 | A1 | 8/2006 | Borchardt |
| 2006/0201576 | A1 | 9/2006 | Domenig |
| 2006/0213148 | A1 | 9/2006 | Baptista |
| 2006/0225787 | A1 | 10/2006 | Newrones et al. |
| 2006/0228057 | A1 | 10/2006 | Newrones et al. |
| 2006/0231556 | A1 | 10/2006 | Wei |
| 2006/0251841 | A1 | 11/2006 | Yang et al. |
| 2006/0263497 | A1 | 11/2006 | Hoffman |
| 2006/0283148 | A1 | 12/2006 | Zimmermann et al. |
| 2006/0292322 | A1 | 12/2006 | Nakajima et al. |
| 2007/0090109 | A1 | 4/2007 | Gustavsson |
| 2007/0130733 | A1 | 6/2007 | Kasai |
| 2007/0154118 | A1 | 7/2007 | Tilman et al. |
| 2007/0155607 | A1 | 7/2007 | Bassett et al. |
| 2007/0172157 | A1 | 7/2007 | Buchman |
| 2007/0232473 | A1 | 10/2007 | Hartman et al. |

FOREIGN PATENT DOCUMENTS

| | | |
|---|---|---|
| CH | 103950 | 4/1924 |
| DE | 56 73 11 | 12/1932 |
| DE | 1 901 372 U | 7/1964 |
| DE | 1 963 002 | 6/1967 |
| DE | 1 290 073 | 2/1969 |
| DE | 1 486 280 | 4/1969 |
| DE | 1 486 733 | 6/1969 |
| DE | 1 411 644 | 7/1969 |
| DE | 23 31 862 | 1/1975 |
| DE | 24 54 248 | 5/1976 |
| DE | 27 47 071 | 4/1979 |
| DE | 27 52 184 | 6/1979 |
| DE | 28 48 835 | 5/1980 |
| DE | 31 05 809 | 9/1982 |
| DE | 33 12 887 | 10/1984 |
| DE | 35 06 116 | 9/1985 |
| DE | 34 11 371 | 10/1985 |
| DE | 86 10 240 | 7/1986 |
| DE | 35 21 373 | 12/1986 |
| DE | 90 07 143 | 8/1990 |
| DE | 93 00 361 | 1/1994 |
| DE | 43 05 065 | 8/1994 |
| DE | 198 43 430 | 2/2000 |
| EP | 144 011 | 6/1985 |
| EP | 149 695 | 7/1985 |
| EP | 212 201 | 3/1987 |
| EP | 373 833 | 6/1990 |
| EP | 402 625 | 12/1990 |
| EP | 450 741 | 10/1991 |
| EP | 505 057 | 9/1992 |
| EP | 633 193 | 1/1995 |
| EP | 729 901 | 9/1996 |
| EP | 767 105 | 4/1997 |
| EP | 808 776 | 11/1997 |
| EP | 1 231 155 | 8/2002 |
| EP | 1 407 681 | 4/2004 |
| FR | 2 353 452 | 6/1976 |
| FR | 2 380 953 | 2/1978 |
| FR | 2 603 164 | 3/1988 |
| FR | 2 695 108 | 3/1994 |
| GB | 154244 | 11/1920 |
| GB | 311320 | 3/1930 |
| GB | 961222 | 6/1964 |
| GB | 1016476 | 1/1966 |
| GB | 1046963 | 10/1966 |
| GB | 1121514 | 7/1968 |
| GB | 1399502 | 7/1975 |
| GB | 1548244 | 7/1979 |
| GB | 2028081 | 3/1980 |
| GB | 1583503 | 1/1981 |
| GB | 2237553 | 5/1991 |
| IT | 592 574 | 5/1959 |
| JP | 54-90311 | 6/1979 |
| JP | 55-090364 | 7/1980 |
| JP | 57-21579 | 2/1982 |
| JP | 61-166960 | 10/1986 |
| JP | 62-99534 | 6/1987 |
| JP | 62-192779 | 8/1987 |
| JP | 63-6278 | 1/1988 |
| JP | 63-6279 | 1/1988 |
| JP | 63-117180 | 5/1988 |
| JP | 63-203559 | 8/1988 |
| JP | 1-099925 | 4/1989 |
| JP | 1-279073 | 11/1989 |
| JP | 3-29759 | 2/1991 |
| JP | 3-212355 | 9/1991 |
| JP | 4-13543 | 2/1992 |
| JP | 4-13544 | 2/1992 |
| JP | 4-60847 | 5/1992 |
| JP | 5-051039 | 3/1993 |
| JP | 5-124656 | 5/1993 |
| JP | 6-3846 | 1/1994 |
| JP | 6-99991 | 4/1994 |
| JP | 6-329179 | 11/1994 |
| JP | 7-839 | 1/1995 |
| JP | 8-011942 | 1/1996 |
| JP | 8-198274 | 8/1996 |
| JP | 2000-281084 | 10/2000 |
| JP | 2001-173818 | 6/2001 |
| JP | 2001-233383 | 8/2001 |
| JP | 2001-247137 | 9/2001 |
| JP | 2002-193273 | 7/2002 |
| JP | 2002-302164 | 10/2002 |
| JP | 2003-507264 | 2/2003 |
| JP | 2004-123228 | 4/2004 |
| JP | 2004-531435 | 10/2004 |
| JP | 2004-359292 | 12/2004 |
| JP | 2006-044751 | 2/2006 |
| WO | WO 88/07479 | 10/1988 |
| WO | WO 98/57862 | 12/1998 |
| WO | WO 00/71422 | 11/2000 |
| WO | WO 01/94227 | 12/2001 |
| WO | WO 02/14161 | 2/2002 |
| WO | WO 02/30772 | 4/2002 |
| WO | WO 02/074522 | 9/2002 |
| WO | WO 03/001096 | 1/2003 |
| WO | WO 2004/002840 | 1/2004 |
| WO | WO 2004/002841 | 1/2004 |
| WO | WO 2004/002850 | 1/2004 |
| WO | WO 2004/078590 | 9/2004 |
| WO | WO 2004/078591 | 9/2004 |
| WO | WO 2004/078609 | 9/2004 |
| WO | WO 2004/108556 | 12/2004 |
| WO | WO 2004/108557 | 12/2004 |
| WO | WO 2005/000706 | 1/2005 |
| WO | WO 2005/012092 | 2/2005 |
| WO | WO 2005/016774 | 2/2005 |
| WO | WO 2005/040005 | 5/2005 |
| WO | WO 2006/127739 | 11/2006 |

* cited by examiner

POUCH WITH A VALVE

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to a check valve, and particularly to a check valve such as may be used on a reclosable thermoplastic pouch.

2. Description of the Background of the Invention

Food or other perishables are often stored in reclosable thermoplastic pouches. To keep food stored inside a pouch fresh for an extended period, a user may evacuate air out of the pouch after completely sealing the pouch using a closure mechanism.

One pouch for packaging of granular solids and small articles is filled and then sealed. The pouch has an interrupted seam between opposing panels of the pouch. The interrupted seam separates a small portion of the pouch from a larger pouch interior. A continuous seam between the opposing pouch panels is disposed proximate to the interrupted seam on a side of the interrupted seam opposite the pouch interior. The opposing pouch panels are flattened between the seams, and an aperture is disposed through one of the opposing pouch panels. Air trapped within the pouch interior during sealing of the pouch may be expelled through the interrupted seam and out of the pouch through the aperture, wherein the flattened panels between the seams act as a valve against the ingress of air.

A further pouch for packaging contents that generate gases is filled and then sealed. The pouch has an interrupted seam between opposing panels of the pouch, wherein the seam is parallel to and proximate to an edge of the pouch. A continuous seam between the opposing pouch panels is disposed between the interrupted seam and the edge of the pouch. A path is defined from a pouch interior to a pouch exterior extending through the interrupted seam and around the ends of the continuous seam. A plurality of puckers is disposed in the material of the opposing panels along the path. The puckers cause the opposing panels to be in contact, thereby effectively forming a normally closed valve. Air within the pouch having an elevated pressure relative to the atmosphere may separate the puckers to escape the pouch, however air from the atmosphere is prevented from entering the pouch.

Another pouch has portions of opposing panels that protrude outwardly from a side of the pouch. The outwardly protruding portions are sealed to one another to form a channel that has a closure mechanism that may be sealed independently from a main closure mechanism disposed across a main pouch opening. The channel may be used to evacuate or to inflate the pouch after the main closure mechanism is sealed.

Yet another pouch has a conduit that extends from an edge of the pouch, wherein the edge is otherwise sealed by a main closure mechanism in juxtaposition with the conduit. The conduit allows communication between an interior of the pouch and an exterior of the pouch for evacuating the pouch after the main closure mechanism is sealed. The conduit has a sealing mechanism that is normally open but that may be squeezed closed to seal the conduit after evacuation of the pouch.

Still another pouch has a first closure mechanism disposed parallel to and proximate to an open end of the pouch. A second closure mechanism is disposed between the first closure mechanism and a closed end of the pouch, and defines a pouch interior. A venting aperture is disposed through the first closure mechanism and at least one panel of the pouch immediately proximate the first closure mechanism. The venting aperture defines a passageway for air between the pouch interior and an exterior of the pouch when the second closure mechanism is open, and the second closure mechanism may be sealed after the pouch is vented through the aperture.

Yet another pouch has a check valve disposed in an end of the pouch opposite a closure mechanism. The check valve has two rectangular narrow films of material sealed together to form a tube, wherein the tube is disposed between opposing panels of the pouch such that one end of the tube is within a pouch interior and a second end of the tube projects outside of the pouch interior. The tube further has a folded piece of film material sealingly disposed within the tube. Air within the pouch having an elevated pressure relative to an exterior of the pouch may separate the folds of the folded film material and escape through an aperture therethrough; however, air is prevented from flowing into the pouch interior by the folded film material. The opposing pouch panels are extended and sealed together around a periphery thereof to cover the second end of the tube, leaving an unsealed gap for air to escape to the atmosphere.

A pouch having a normally open valve or a vent may allow contents of the pouch to escape from the pouch. Further, a valve or vent proximate the closed end of a pouch is more likely to leak contents because contents placed into the pouch through a main opening typically settle to a closed end of the pouch. Consequently, excess air within the pouch is most effectively evacuated through the main opening.

SUMMARY OF THE INVENTION

According to one aspect of the invention, a pouch with a valve includes first and second pouch sidewalls sealed to one another to define an opening. A resealable closure mechanism is attached to inner surfaces of the first and second sidewalls proximate the opening to define a pouch interior opposite the opening. A channel extends from the interior to the opening through the closure mechanism in an occluded state. At least one protruding surface is disposed on the inner surface of the first sidewall between the closure mechanism and the opening to sealingly engage the inner surface of the second sidewall to form an airtight seal therebetween.

According to another aspect of the invention, a pouch includes first and second pouch sidewalls sealed to one another to define an opening. A resealable closure mechanism comprises a first closure element and a second closure element, each having a base substantially attached to an inner surface of the first and second sidewalls, respectively, proximate the opening to define a pouch interior opposite the opening. A channel extends from the interior to the opening between the first sidewall and a section of the base of the first closure element not attached to the first sidewall to provide fluid communication between the interior and the opening of the pouch. A pleated member is sealingly disposed in the channel, wherein the pleated member includes an aperture disposed therethrough and is attached to the base of the first closure element and the first sidewall.

According to yet another aspect of the invention, a pouch with a valve includes first and second pouch sidewalls sealed to one another to define an opening. A resealable closure mechanism is attached to inner surfaces of the first and second sidewalls proximate the opening to define a pouch interior opposite the opening. A fluid path provides direct fluid communication between the interior and an exterior of the pouch, wherein the fluid path passes through an edge of the pouch defined by at least one of the first or second pouch sidewalls. A valve is sealingly disposed in the fluid path, wherein the valve comprises a pleated thermoplastic member attached to at least one of the first or second pouch sidewalls and having an aperture disposed through the pleated thermoplastic member to provide fluid communication between the interior and the exterior of the pouch

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
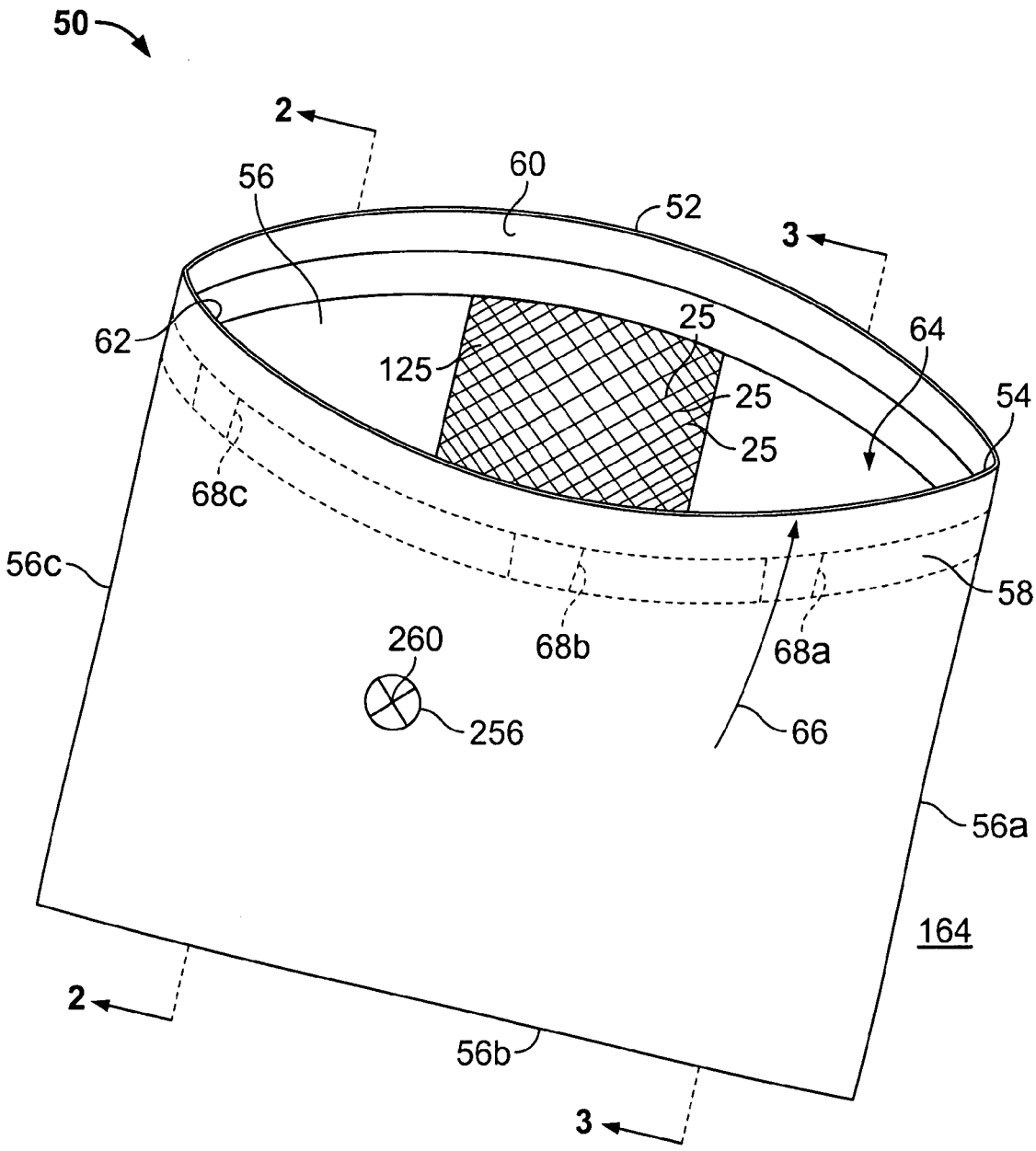
FIG. 1 is an isometric view of a reclosable pouch.

Referring to FIG. 1, a reclosable thermoplastic pouch 50 includes first and second pouch sidewalls 52 and 54 joined around three edges 56*a*-56*c* by heat sealing or other sealing method known in the art to define an opening 56. Alternatively, the bottom edge 56*b* may be a fold line between the first and second side walls 52 and 54. A closure mechanism 58 is attached to inner surfaces 60 and 62 of the first and second sidewalls 52 and 54, respectively, proximate the opening 56. The closure mechanism 58 and the first and second sidewalls 52 and 54 define a pouch interior 64. When occluded, the closure mechanism 58 provides an airtight seal such that a vacuum may be maintained in the pouch interior 64 for a desired period of time, such as days, months, or years, when the closure mechanism is sealed fully across the opening 56. A channel or fluid path is indicated by the arrow 66 and is illustrated by a set of dashed lines 68*a* shown in FIG. 1. The fluid path 66 extends from the pouch interior 60 to the opening 56 bypassing the closure mechanism 58. The fluid path 66 may be disposed through the closure mechanism 58 at any position along the length of the closure mechanism 58, for example, offset from a center of the pouch 50 as illustrated by 68*a*, proximate the center of the pouch 50 as illustrated by 68*b*, or proximate an edge of the pouch 50 as illustrated by 68*c*.

Figure 2:
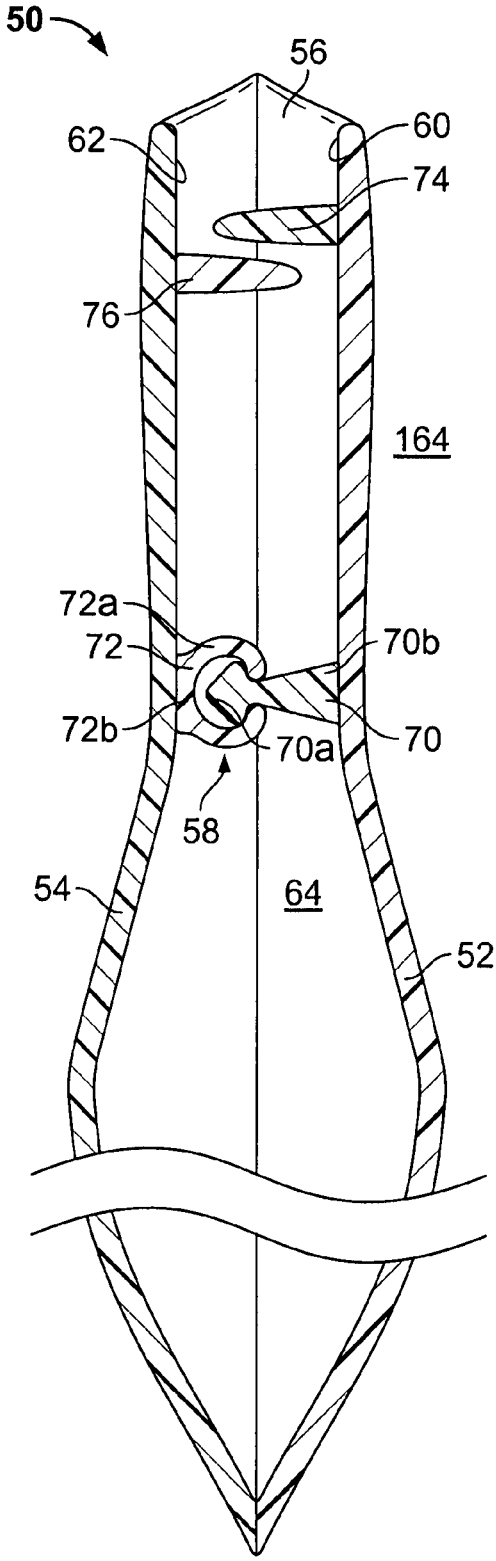
FIG. 2 is a fragmentary cross-sectional view of an embodiment of a pouch taken generally along the lines 2-2 of FIG. 1.

Referring to an embodiment as seen in FIG. 2, the closure mechanism 58 comprises first and second closure elements 70 and 72. The first closure element 70 includes a first base 70*b*, and the second closure element includes a second base 72*b*. The first and second bases 70*b* and 72*b* are respectively attached to the inner surfaces 60 and 62 of the first and second pouch sidewalls 52 and 54. The first closure element 70 includes one or more interlocking closure profiles 70*a*, each extending from the first base 70*b*, and the second closure element 72 includes one or more interlocking closure profiles 72*a*, each extending from the second base 72*b*. The first and second interlocking closure profiles 70*a* and 72*a* are shown in FIG. 2 as male and female closure profiles, respectively. However, the configuration and geometry of the interlocking profiles 70*a*, 72*a* or closure elements 70, 72 shown herein may vary.

In a further embodiment, one or both of the first and second closure elements 70, 72 may include one or more textured portions, such as a bump or crosswise groove in one or more of the interlocking profiles 70*a*, 72*a* in order to provide a tactile sensation, such as a series of clicks, as a user draws the fingers along the closure mechanism 58 to seal the closure elements across the opening 56. In another embodiment, each of the closure profiles 70*a*, 72*a* includes textured portions along the length of the profile to provide tactile and/or audible sensations when closing the closure mechanism 58. Further, in some embodiments, a sealing material such as a polyolefin material or a caulking composition such as silicone grease may be disposed on or in the interlocking profiles 70*a*, 72*a* or closure elements 70, 72 to fill in any gaps or spaces therein when occluded. The ends of the interlocking profiles 70*a*, 72*a* or closure elements 70, 72 may also be welded or sealed by ultrasonic vibrations as is known in the art. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/

0111226. Other interlocking profiles and closure elements useful in the present invention include those disclosed in, for example, U.S. patent application Ser. No. 11/725,120, filed Mar. 16, 2007, and U.S. patent application Ser. Nos. 11/818,585; 11/818,593; and 11/818,586, each filed on Jun. 15, 2007. It is further appreciated that the interlocking profiles 70*a*, 72*a* or closure elements 70, 72 disclosed herein may be operated by hand, or a slider (not shown) may be used to assist in occluding and de-occluding the interlocking profiles and closure elements.

Figure 2A:
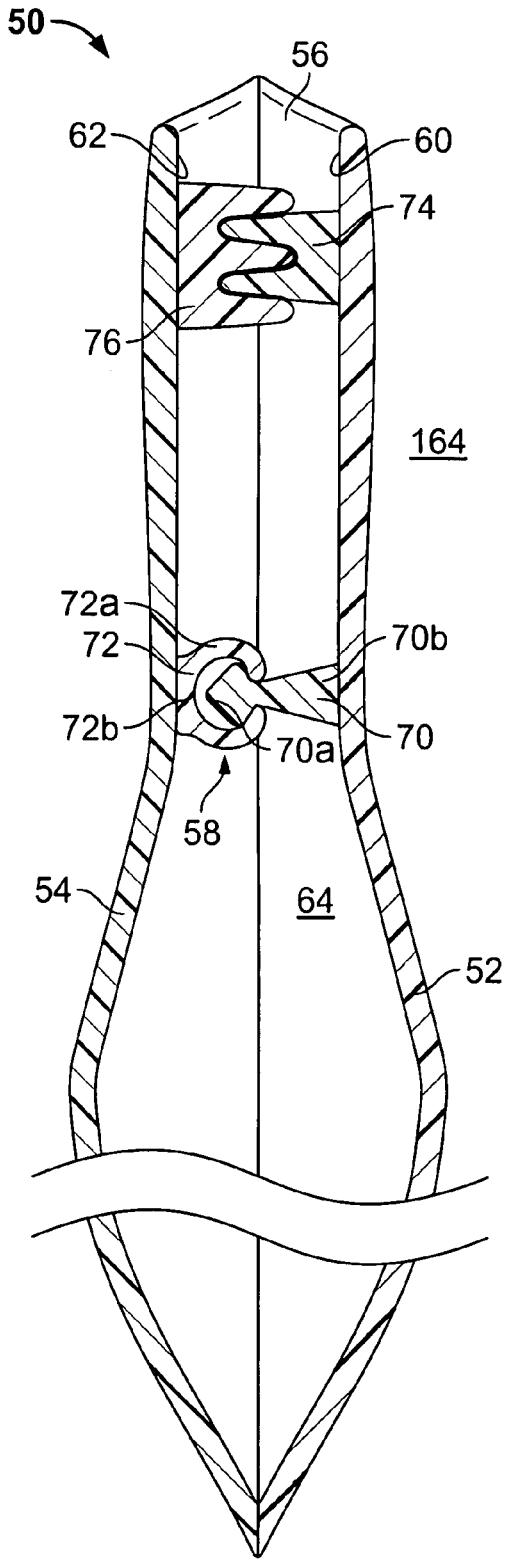
FIG. 2A is a fragmentary cross-sectional view of another embodiment of the pouch taken generally along the lines 2-2 of FIG. 1.

At least one protruding surface 74 or 76 is disposed on the inner surface 60 or 62 of one of the first or second sidewalls 52 or 54, respectively. In some embodiments, the protruding surface 74 may serve a dual purpose. The protruding surface 74 may provide a surface for gripping the pouch 50 near the opening 56, or be capable of sealingly engaging the inner surface 62 of the opposite sidewall 54. Other embodiments include one or more protruding surfaces 74 and 76 disposed on each of the inner surfaces 60 and 62. Another embodiment having a plurality of protruding surfaces 74 and 76 disposed on each of the inner surfaces 60 and 62, respectively, is illustrated in FIG. 2A, which is cross-sectional view of the pouch taken generally along the lines 2-2. The pluralities of protruding surfaces 74 and 76 intermesh when the pouch is closed to form a substantially continuous interface therebetween, as will be discussed in greater detail below.

Figure 3:
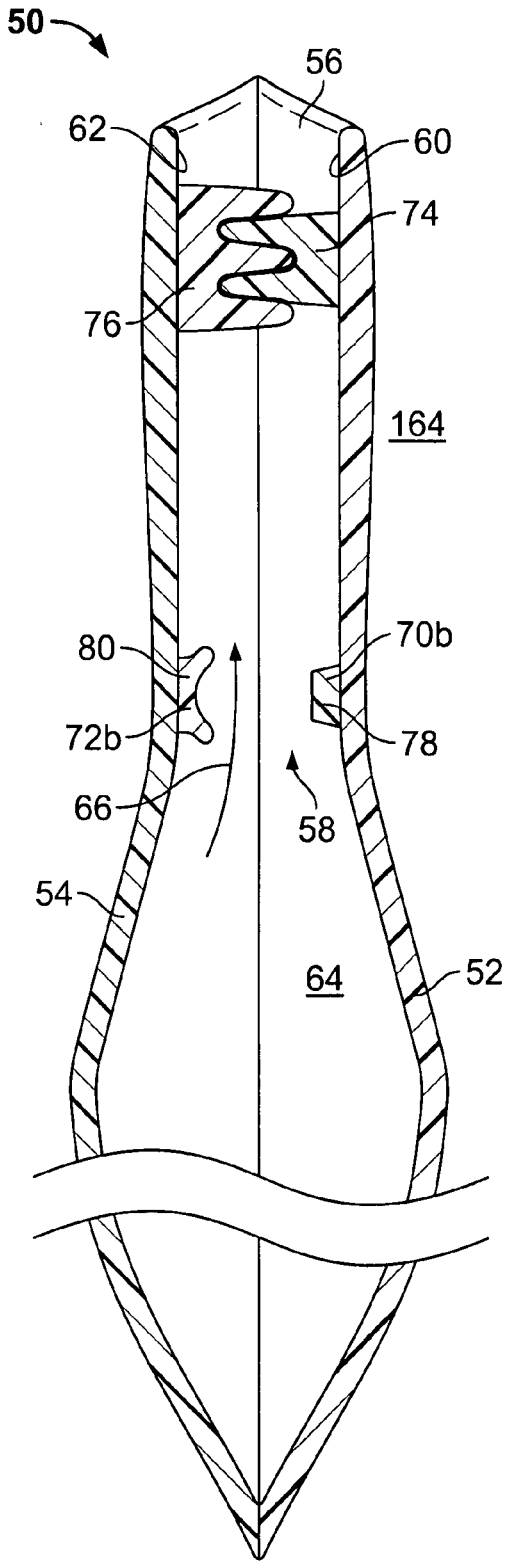
FIG. 3 is a fragmentary cross-sectional view of the embodiment of FIG. 2A taken generally along the lines 3-3 of FIG. 1.

Referring next to FIG. 3, the first and second profiles 70*a* and 72*a* of FIG. 2A are deformed proximate the fluid path 66 to form flattened first and second profiles 78 and 80. With this deformation, the closure mechanism 58 in a fully occluded state is sealed along an entire length thereof except for a region defining the fluid path 66 extending through the closure mechanism 58 and bounded by one set of the sets of dashed lines 68*a-c* shown in FIG. 1.

Referring to FIGS. 1, 2A, and 3, the operation of the pouch 50 will be described under the assumption that the closure mechanism 58 is sealed and the pluralities of protruding surfaces 74 and 76 are intermeshed. An increase in fluid pressure in the pouch interior 64 relative to an exterior 164 of the pouch 50 results in pressurized fluid passing between the flattened first and second profiles 78 and 80 of the closure mechanism 58 and entering the fluid path 66. Once through the flattened first and second profiles 78 and 80 of the closure mechanism 58, the pressurized fluid exerts a force on the first and second sidewalls 52 and 54 that separates the previously intermeshed pluralities of protruding surfaces 74 and 76, and thereby allows fluid to escape the pouch interior 64.

Conversely, a decrease in fluid pressure in the pouch interior 64 relative to the exterior 164 of the pouch 50 results in the pluralities of protruding surfaces 74 and 76 being forced together. Illustratively, the protruding surfaces 74 and 76 are complementarily shaped so that the meshing of the protruding surfaces 74 and 76 and the resultant seal therebetween inhibits or prevents fluid from the exterior 164 of the pouch 50 from entering the pouch interior 64. Thus, the pluralities of protruding surfaces 74 and 76 allow fluid to escape from the pouch interior 64, but inhibit or prevent fluid from entering the pouch interior 64. If desired, the protruding surfaces 74 and 76 may have non-complementary shapes, in which case at least one of the protruding surfaces 74 or 76 includes a member that seals against at least one of the other of the protruding surfaces 74 or 76 to provide the desired check valve operation.

Figure 4:
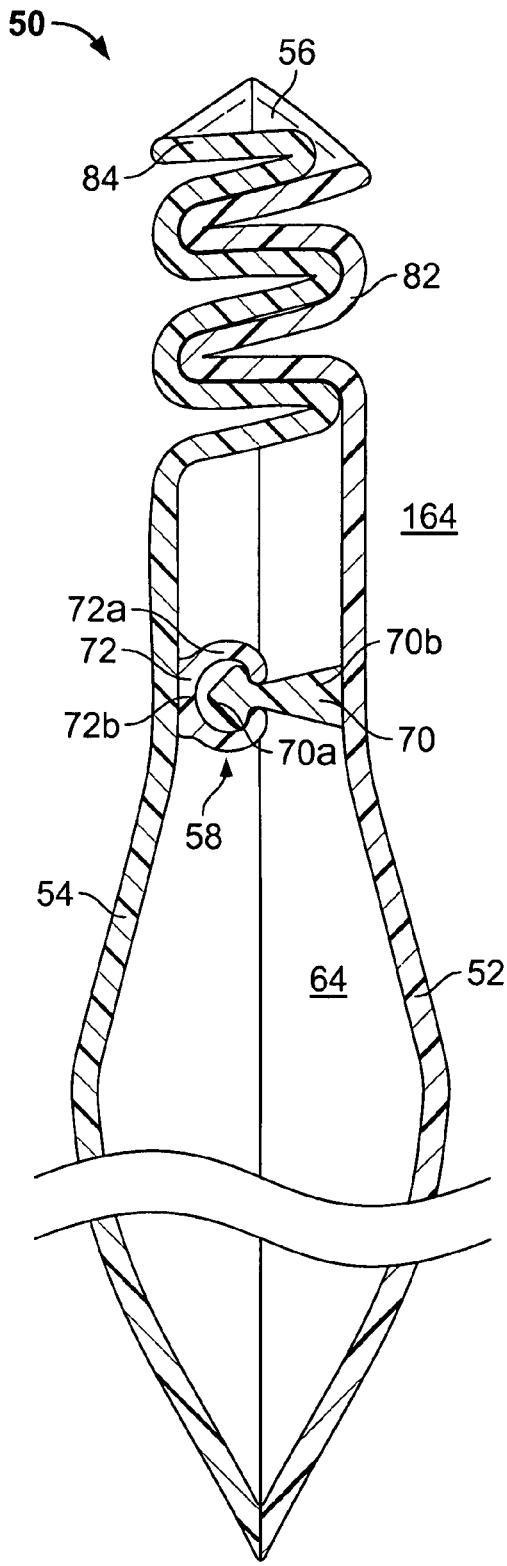
FIG. 4 is a fragmentary cross-sectional view of a further embodiment of the pouch taken generally along the lines 2-2 of FIG. 1.

In a further embodiment as seen in FIG. 4, the first and second pouch sidewalls 52 and 54 include respective first and second corrugated cross sections 82 and 84. The first and second corrugated cross sections 82 and 84 serve similar purposes as the first and second pluralities of protruding surfaces 74 and 76 shown in FIG. 2A and described above.

Figure 5:
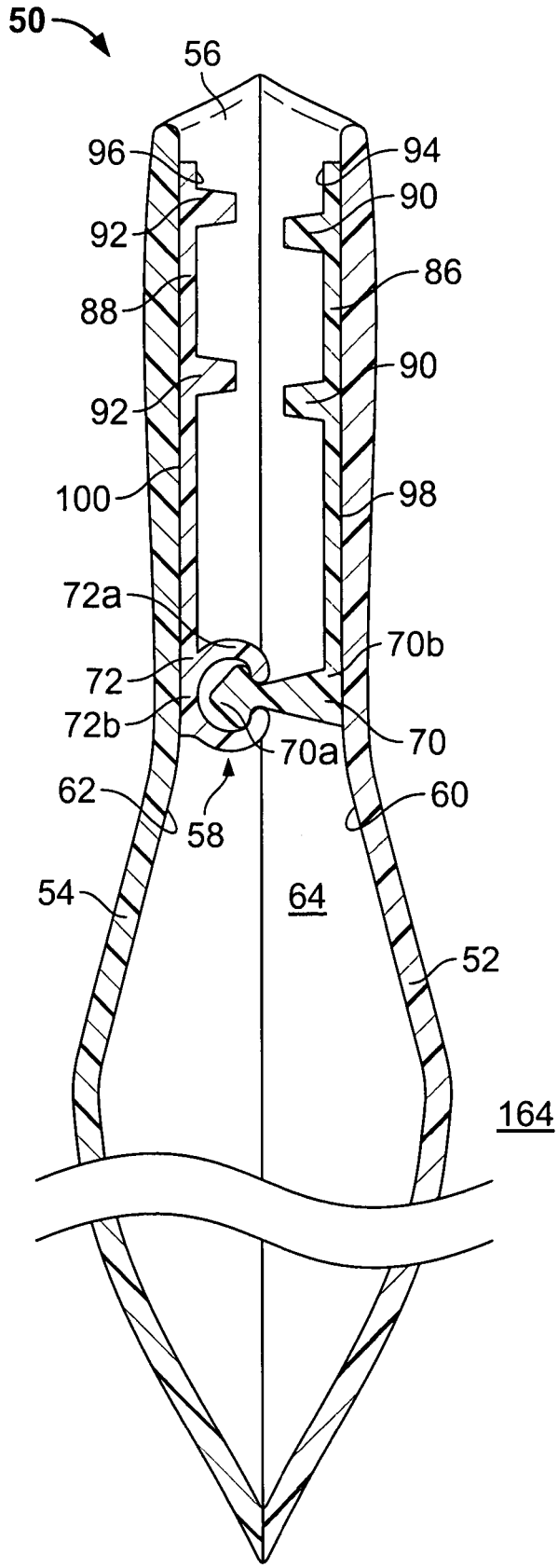
FIG. 5 is a fragmentary cross-sectional view of a still further embodiment of the pouch taken generally along the lines 2-2 of FIG. 1.

A still further embodiment is illustrated in FIG. 5, wherein the closure mechanism 58 again comprises first and second closure elements 70 and 72, respectively, comprising first and second interlocking closure profiles 70*a* and 72*a* that are represented as male and female profiles but which may have any configuration or geometry as noted previously. The first and second closure elements 70 and 72 also respectively comprise the first and second bases 70*b* and 72*b*. In this embodiment, the first closure element 70 includes a first flange 86 that extends toward the opening 56 from the first base 70*b*, and the second closure element 72 includes a second flange 88 that extends toward the opening 56 from the second base 72*b*. One or more first and second gripping ribs 90 and 92 may optionally be disposed extending toward one another from inner surfaces 94 and 96 of the first and second flanges 86 and 88, respectively. Each of the first and second closure elements 70 and 72 includes an outer surface 98 and 100, respectively, that is substantially flat. These outer surfaces 98 and 100 are attached to inner surfaces 60 and 62 of the first and second sidewalls 52 and 54, respectively, by any suitable means known in the art.

Figure 6:
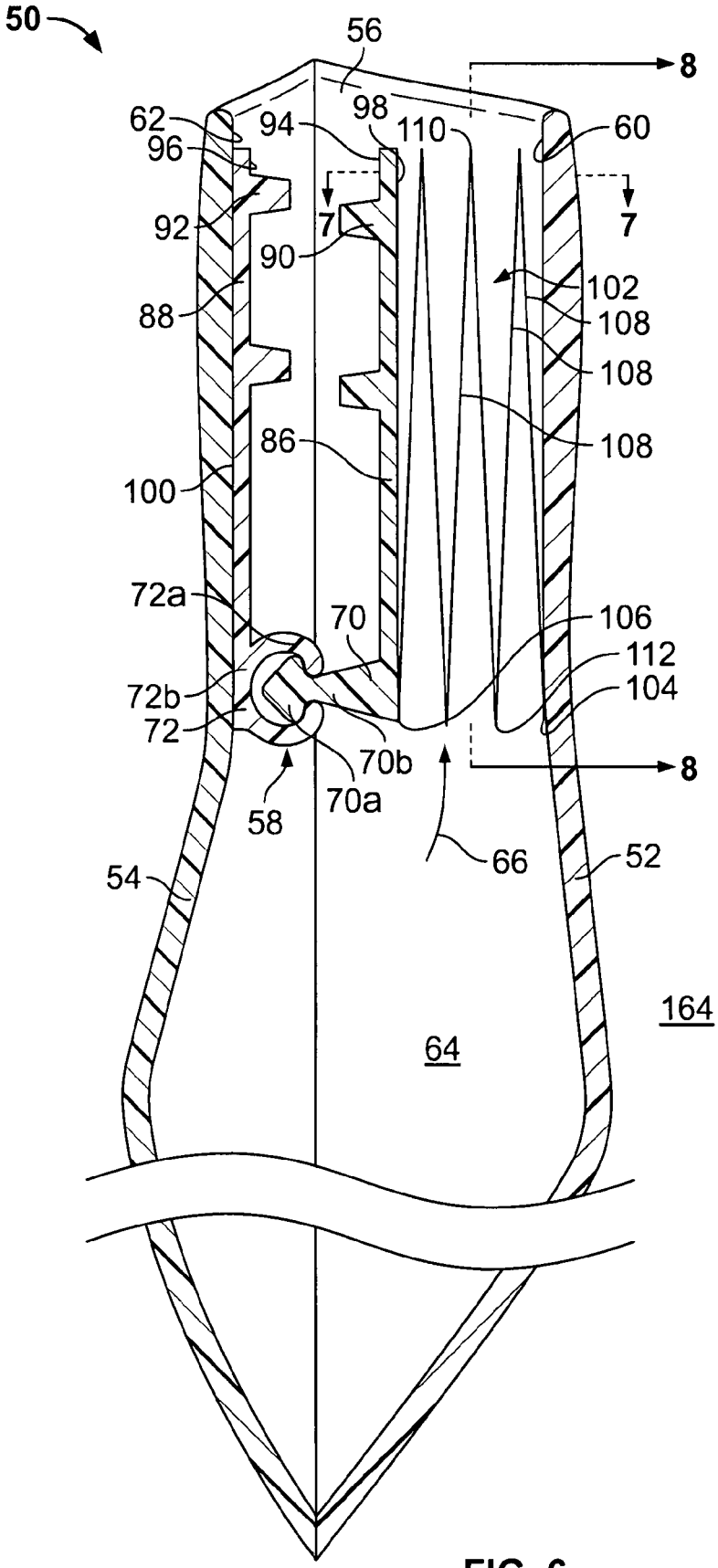
FIG. 6 is a fragmentary cross-sectional view of the embodiment illustrated in FIG. 5 taken generally along the lines 3-3 of FIG. 1.

Referring next to FIG. 6, the fluid path 66 is defined by a region of the closure mechanism 58 that is not directly attached to the first pouch sidewall 52 in the area bounded by one set of the sets of dashed lines 68*a-c* (shown in FIG. 1). In this area, the first closure element 70 is attached by a pleated member 102 to the inner surface 60 of the first sidewall 52. The closure mechanism 58 in a fully occluded state seals the pouch interior 64 from the opening 56 along an entire length of the closure mechanism 58 except for the indirectly attached region defining the fluid path 66. The fluid path 66 may be disposed around the closure mechanism 58 in this fashion at any position along the length of the closure mechanism 58, for example, proximate the center, offset from the center, or proximate an edge of the pouch, etc.

The pleated member 102 is sealed at a first end 104 to the inner surface 60 of the first sidewall 52 and at a second end 106 to the outer surface 98 of the first closure element 70. Flat sections 108 of the pleated member 102 extend away from the inner surface 60 and the outer surface 98 toward the opening 56. The flat sections 108 are connected to one another along outer fold lines 110 and inner fold lines 112, thereby giving the pleated member 102 a pleated appearance. Although the pleated member 102 is shown in FIG. 6 as extending between the first and second sealed ends 104 and 106 toward the opening 56, the pleated member 102 may alternately extend in an opposite direction toward the pouch interior 64. Also, although a pleated member 102 with multiple pleats is shown in FIG. 6, the pleated member 102 may also consist of any number of pleats including a single pleat.

Figure 7:
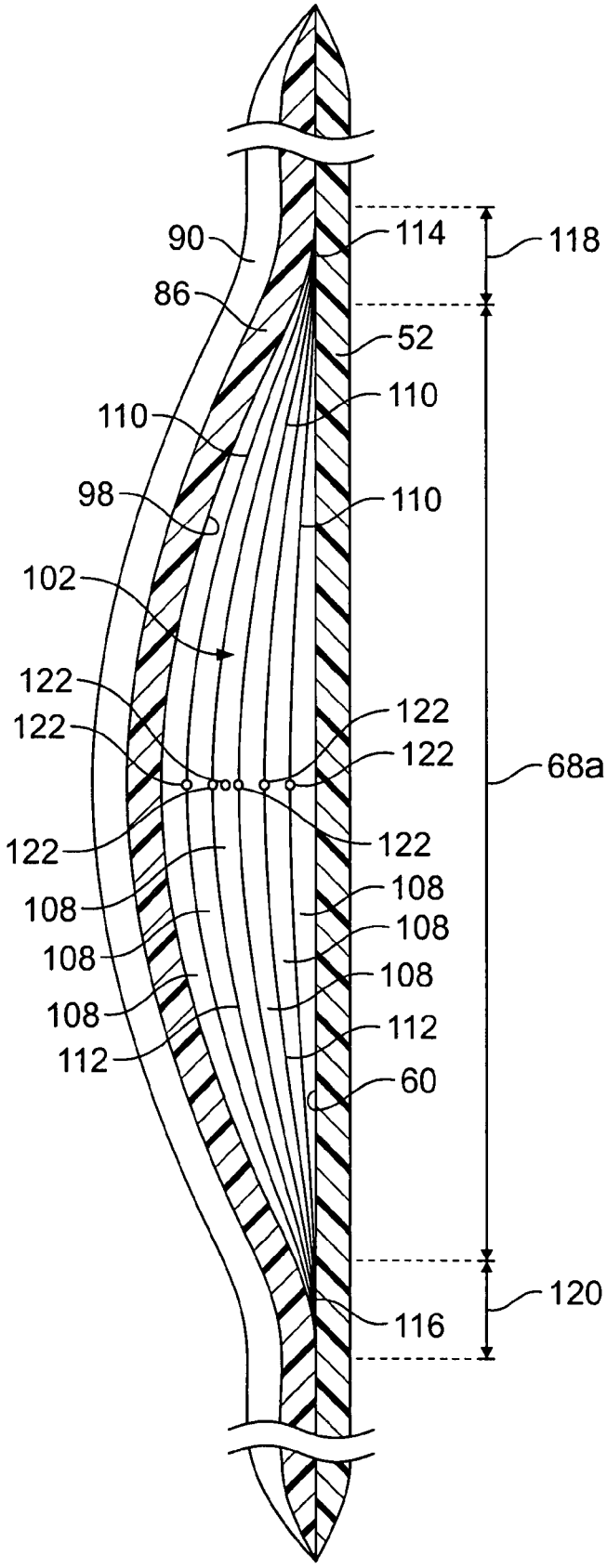
FIG. 7 is a fragmentary cross-sectional view taken generally along the lines 7-7 of FIG. 6.

Referring next to FIGS. 6 and 7, the pleated member 102 is wider than the width 68 of the fluid path 66 and has first and second lateral edges 114 and 116 that are respectively sealed in first and second overlap regions 118 and 120 between the first sidewall 52 and the first closure element 70. Therefore, the pleated member 102 is sealingly disposed within the fluid path 66 by seals at the first and second ends 104 and 106 shown in FIG. 6 and along the first and second lateral edges 114 and 116.

Figure 8:
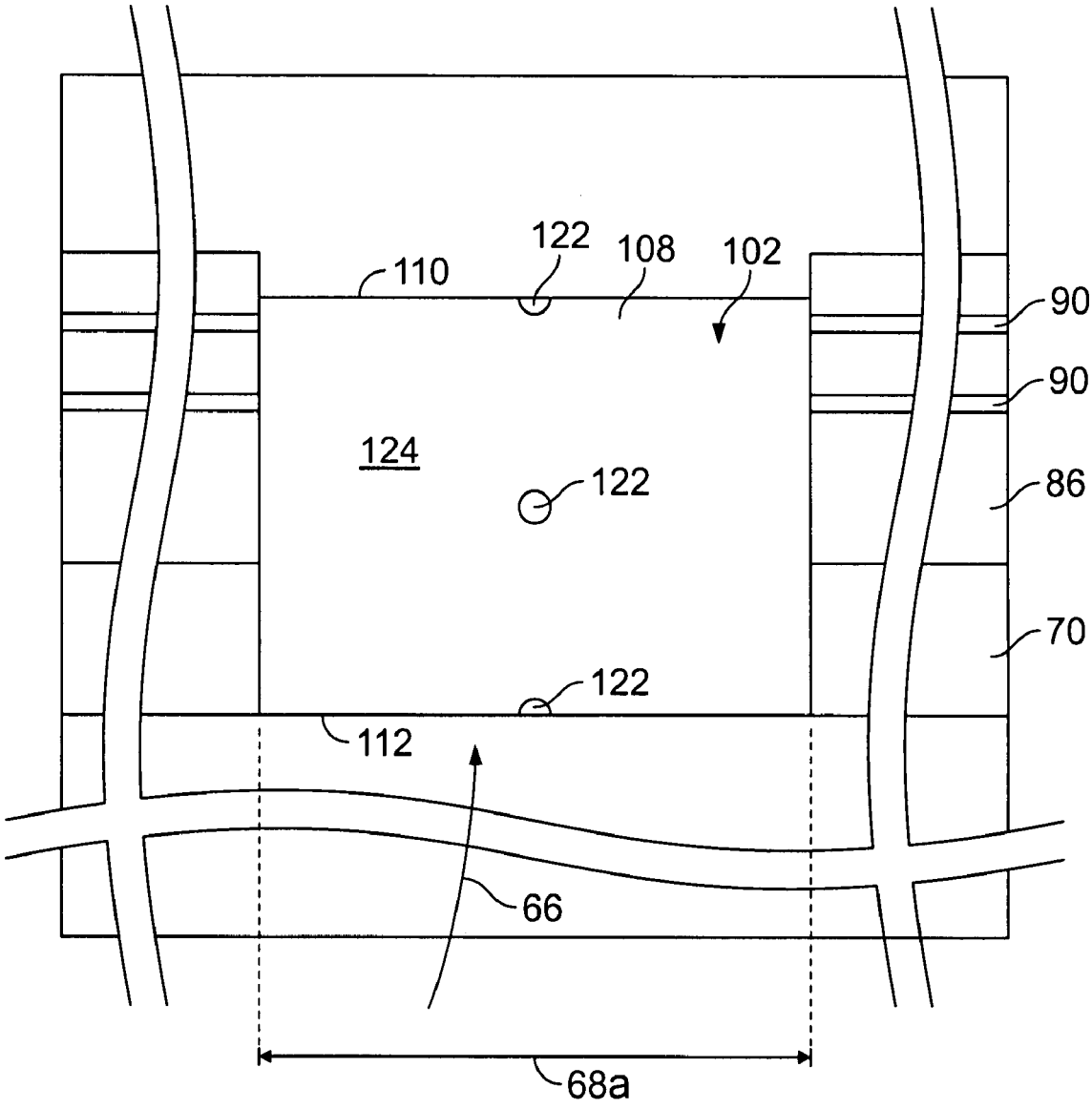
FIG. 8 is a fragmentary cross-sectional view taken generally along the lines 8-8 of FIG. 6.

Referring next to FIG. 8, the pleated member 102 includes an aperture 122 through one or more of the flat sections 108. The aperture 122 may be disposed in the outer fold line 110 or in the inner fold line 112. The aperture 122 may also be spaced from the fold lines 110 and 112 toward a central region 124 of the flat section 108. The aperture 122 could also be longitudinally centered on the flat section 108 or could be offset from the center, or generally located anywhere on the pleated member 102 such that the flat sections 108 of the pleated member may come together to form a substantial seal across the width 68 of the fluid path 66. Further, any number of apertures 122 may be disposed through any number of the flat sections 108 as long as the flat sections 108 of the pleated member 102 may come together to form a substantial seal across the width 68*a* of the fluid path 66. Although the aperture 122 is illustrated in FIG. 8 as being circular, the aperture 122 may comprise a slit or may have any cross-sectional shape, for example elliptical, square-shaped, triangular, pentagonal, hexagonal, etc.

In one embodiment, the first and second sidewalls 52, 54, the pleated member 102, and/or the closure mechanism 58 are formed from thermoplastic resins by known extrusion methods. For example, the sidewalls 52, 54 may be independently extruded of thermoplastic material as a single continuous or multi-ply web, and the closure mechanism 58 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, the pleated member 102, or a portion thereof, or the inner surfaces 60, 62 of the respective sidewalls 52, 54 or a portion or area thereof may, for example, be composed of a polyolefin plastomer such as an AFFINITY™ resin manufactured by Dow Plastics. Such portions or areas include, for example, the area of one or both of the sidewalls 52, 54 proximate and parallel to the closure mechanism 58 to provide an additional cohesive seal between the sidewalls when the pouch 50 is evacuated. One or more of the sidewalls 52, 54 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 52, 54. The barrier layer may be, for example, adhesively secured between the PP and/or LDPE plies to provide a multilayer film. Other additives such as colorants, slip agents, and antioxidants, including for example talc, oleamide or hydroxyl hydrocinnamate may also be added as desired. In another embodiment, the closure mechanism 58 may be extruded primarily of molten PE with various amounts of slip component, colorant, and talc additives in a separate process. The fully formed closure mechanism 58 or the pleated member 102 may be attached to each other or to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

The resealable pouch described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

Referring to the embodiment described in FIGS. 5-8, the operation of the pouch 50 with the pleated member 102 will be described under the assumption that the pouch 50 is in a closed state and the flat sections 108 of the pleated member 102 are in contact with one another forming a substantial seal therebetween. An increase in fluid pressure in the pouch interior 64 relative to the exterior 164 of the pouch 50 results in pressurized fluid entering the fluid path 66 and pushing the first sidewall 52 away from the first closure element 70, thereby separating the flat sections 108 from one another. Separation of the flat sections 108 exposes the aperture 122 to the pressurized fluid, thereby allowing the pressurized fluid to escape the pouch interior 64 through the aperture 122.

Conversely, a decrease in fluid pressure in the pouch interior 64 relative to the exterior 164 of the pouch 50 results in the first sidewall 52 and the first closure element 70 being forced together. Contact between the flat sections 108 and the resultant seal therebetween inhibits or prevents fluid from the exterior 164 of the pouch 50 from entering the pouch interior 64. Thus, the pleated member 102 having an aperture 122 therethrough functions as a check valve that allows fluid to escape from the pouch interior 64, but inhibits or prevents fluid from entering the pouch interior 64.

Figure 9:
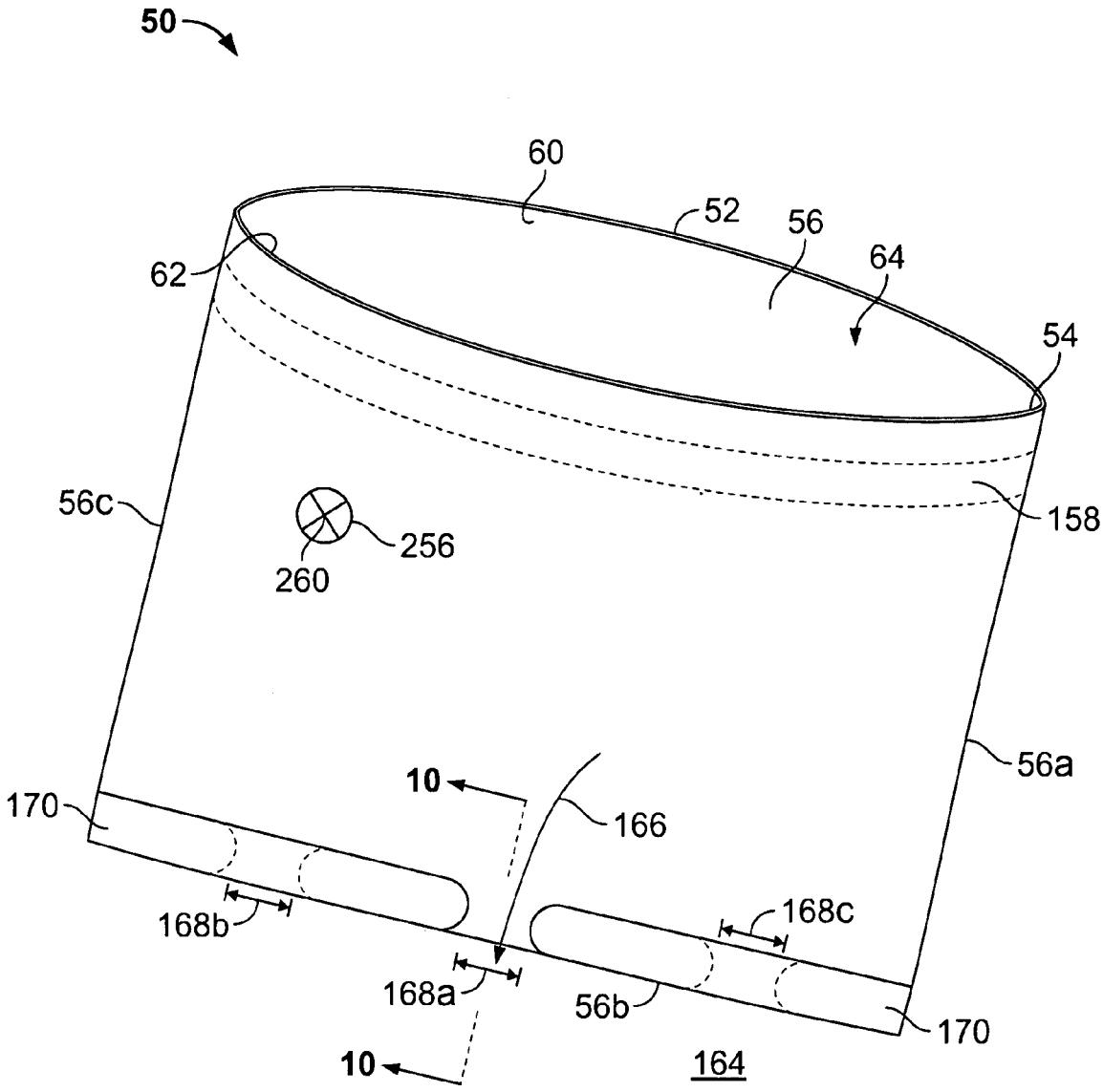
FIG. 9 is an isometric view of yet another embodiment of the pouch.
Figure 10:
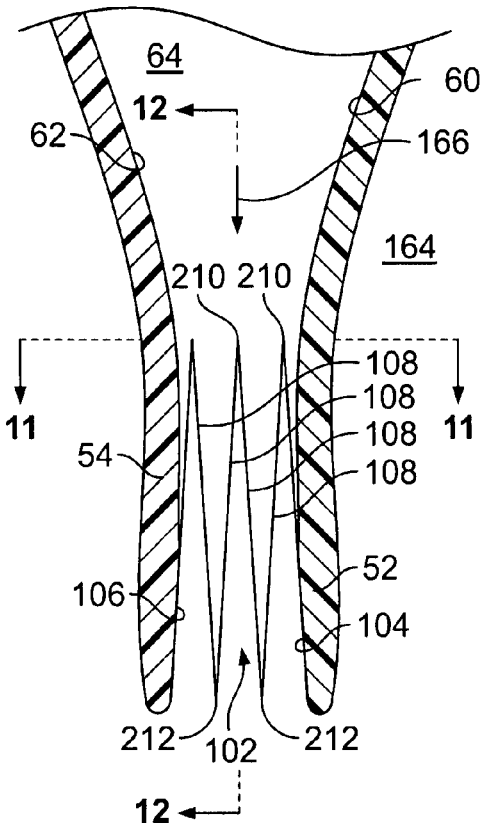
FIG. 10 is a fragmentary cross-sectional view taken generally along the lines 10-10 of FIG. 9 with portions behind the plane of the cross-section omitted for clarity.

Referring to FIGS. 9 and 10, in yet another embodiment, the pleated member 102 is disposed on an edge 56*a*-56*c* of the pouch 50 not including the opening 56, for example, along the bottom edge 56*b*. This embodiment is similar to the embodiment described above in regard to FIGS. 5-8, except for the following differences. A closure mechanism 158 includes first and second closure elements (not shown) that may have any configuration or geometry as noted previously. In this embodiment, the closure mechanism 158 in a fully occluded state seals the pouch interior 64 from the opening 56 along an entire length of the closure mechanism. A fluid path 166 is defined by a region along one or more of the side edges 56*a*-56*c* of the pouch, for example, along the bottom edge 56*b* in an area illustrated in FIG. 9 by 168*a*, 168*b*, or 168*c*. The fluid path 166 extends through a bar seal 170 that otherwise seals the edge 56*a*, 56*b*, or 56*c* through which the fluid path extends. The fluid path 166 may be disposed through each of the edges 56*a*-56*c* in this fashion at any position along each edge, for example, proximate the center, offset from the center, or proximate a corner of the pouch, etc. The fluid path 166 provides fluid communication between the pouch interior 64 and the exterior 164 of the pouch 50.

The pleated member 102 is sealed at the first end 104 to the inner surface 60 of the first sidewall 52 and at the second end 106 to the inner surface 62 of the second sidewall 54. The flat sections 108 of the pleated member 102 extend away from the inner surfaces 60 and 62 toward the pouch interior 64. The flat sections 108 are connected to one another along inner fold lines 210 and outer fold lines 212, thereby giving the pleated member 102 a pleated appearance. Although the pleated member 102 is illustrated having multiple pleats in FIG. 10, the pleated member 102 may also consist of any number of pleats including a single pleat, with each pleat, or portions thereof, being made of the same or different materials.

Figure 11:
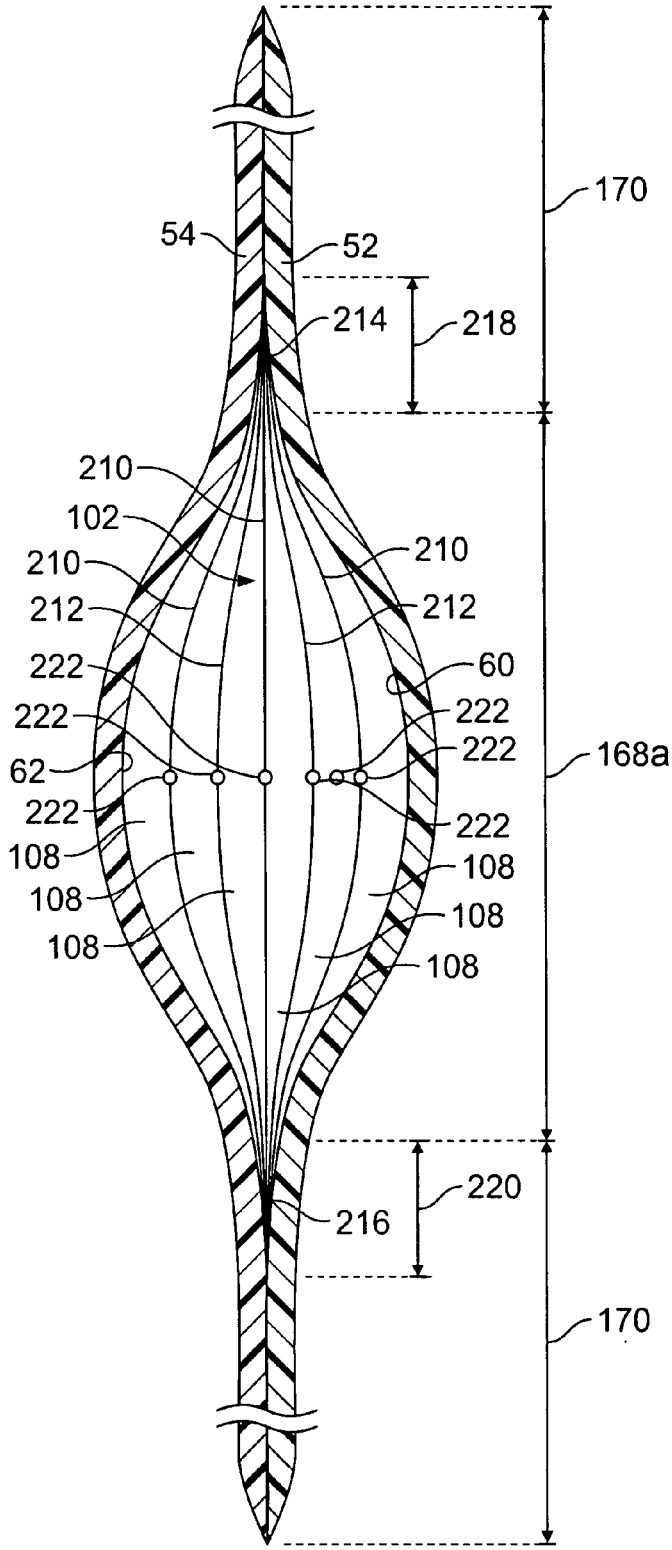
FIG. 11 is a fragmentary cross-sectional view taken generally along the lines 11-11 of FIG. 10.
Figure 12:
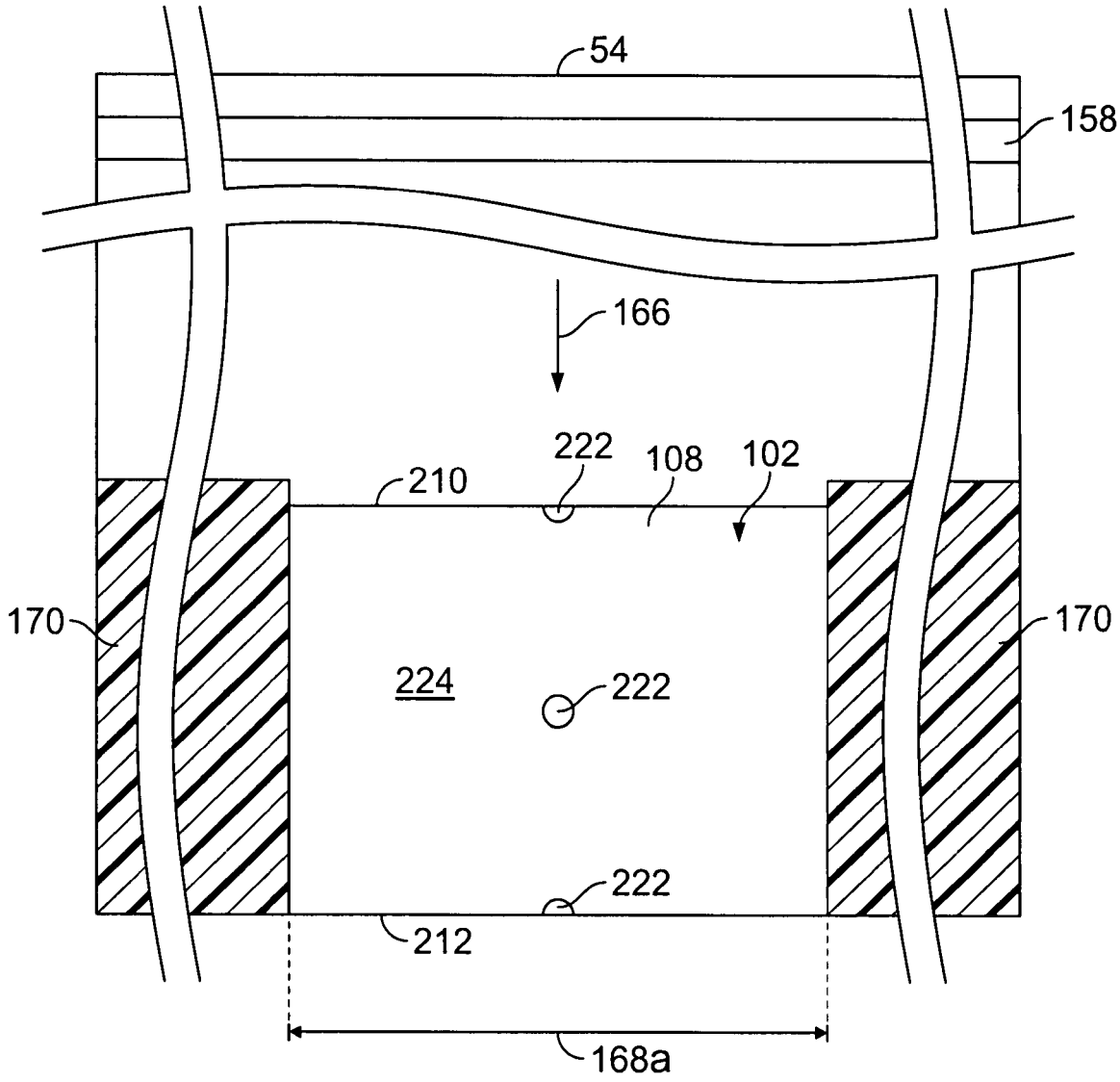
FIG. 12 is a fragmentary cross-sectional view taken generally along the lines 12-12 of FIG. 10.

Referring next to FIGS. 11 and 12, the pleated member 102 is wider than the width 168*a* of the fluid path 166 and has first and second lateral edges 214 and 216 that are respectively sealed in first and second overlap regions 218 and 220 between the first sidewall 52 and the second sidewall 54. Therefore, the pleated member 102 is sealingly disposed within the fluid path 166 by seals at the first and second ends 104 and 106 shown in FIG. 10 and along the first and second lateral edges 214 and 216.

Referring next to FIG. 12, the pleated member 102 may include an aperture 122 through one or more of the flat sections 108. The aperture 222 may be disposed in one or more of the inner fold lines 210 or in one or more of the outer fold lines 212. Illustratively, a pleated member 102 having several flat sections 108 may have a single aperture 222 disposed through a single inner fold line 210 centrally disposed between the first and second ends 104 and 106. The aperture 222 may also be spaced from the fold lines 210 and 212 toward a central region 224 of the flat section 108. The aperture 222 could also be longitudinally centered on the flat section 108 or could be offset from the center, or generally located anywhere on the pleated member 102 such that the flat sections 108 of the pleated member may come together to form a substantial seal across the width 168*a* of the fluid path 166. Further, any number of apertures 222 may be disposed through any number of the flat sections 108 as long as the flat sections 108 of the pleated member 102 may come together to form a substantial seal across the width 168*a* of the fluid path 166. Although the aperture 222 is illustrated in FIG. 12 as being circular, the aperture 222 may comprise a slit or may have any cross-sectional shape, for example elliptical, square-shaped, triangular, pentagonal, hexagonal, etc. This embodiment operates in a similar fashion to the embodiment described with regard to FIGS. 5-8 above to provide a direct fluid path through the pleated member 102 between the pouch interior 64 and the pouch exterior 164.

Figure 13:
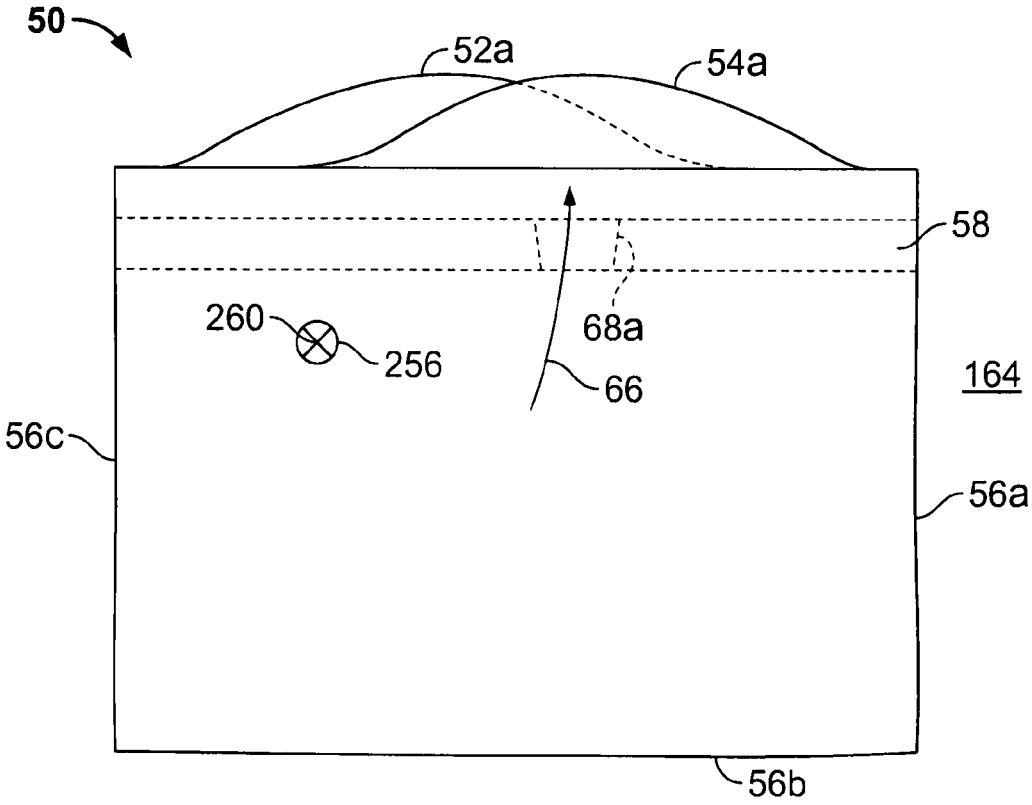
FIG. 13 is a plan view of another embodiment of the pouch having flaps.
Figure 14:
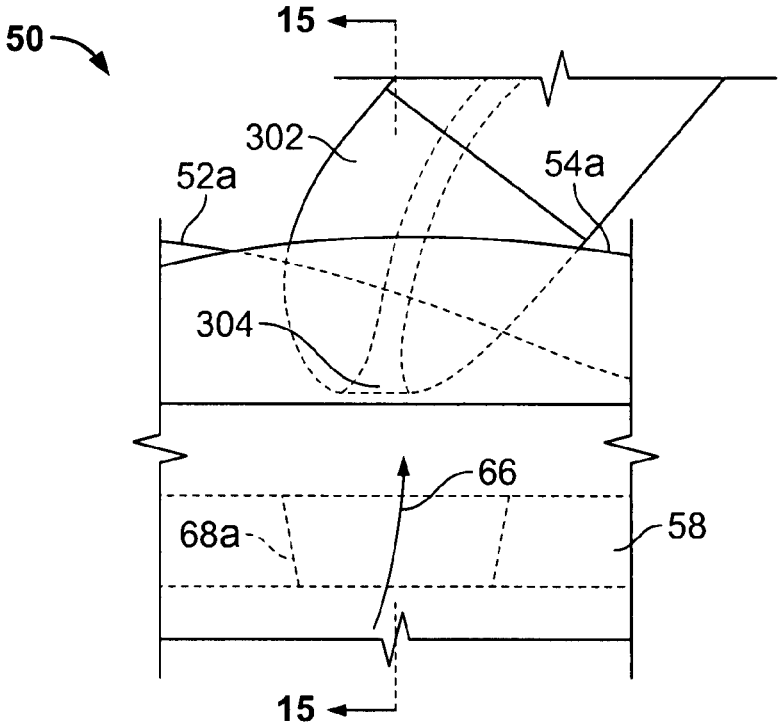
FIG. 14 is a fragmentary plan view of a vacuum device applied to the pouch.
Figure 15:
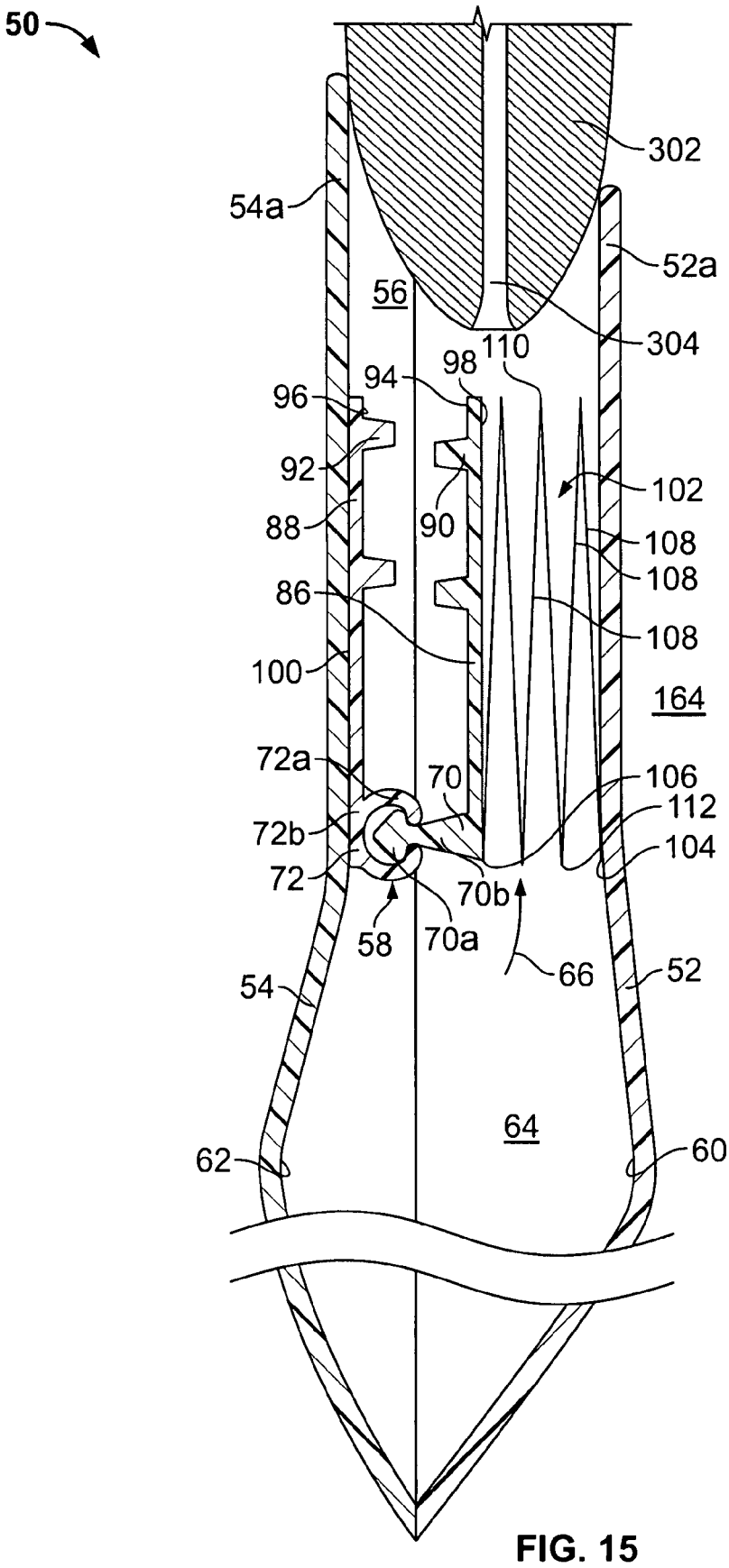
FIG. 15 is a fragmentary cross-sectional view taken generally along the lines 15-15 of FIG. 14 with portions behind the plane of the cross-section omitted for clarity.

As illustrated in FIGS. 13-15, another embodiment of the pouch 50 may have flaps 52*a* and 54*a* that extend from the first and second sidewalls 52 and 54, respectively. A nozzle 302 of an evacuation device (not shown) is illustrated in FIGS. 14 and 15, and includes a nozzle orifice 304 that may be inserted between the flaps 52*a* and 54*a* to draw a vacuum on the fluid path 66 to evacuate the pouch 50. Illustrative evacuation pumps or devices useful in the present invention include those disclosed in, for example, U.S. patent application Ser. No. 11/818,703, filed on Jun. 15, 2007.

In other embodiments, the pouch 50 may include a second opening 256 as shown in FIG. 1 through one of the sidewalls 52, 54 covered by a valve 260, such as a check or one-way valve, to allow air to be evacuated from the pouch interior 64 and maintain a vacuum when the closure mechanism 58 or 158 has been sealed. The valve 260 may be disposed on the second sidewall 54 spaced from the closure mechanism 58. The valve 260 provides a fluid path with fluid communication between the pouch interior 64 and the exterior 164 of the pouch. Illustrative valves useful in the present invention include those disclosed in, for example, Newrones et al. U.S. Patent application publication No. 2006/0228057. Other valves useful in the present invention include those disclosed in, for example, U.S. patent application Ser. Nos. 11/818,586 and 11/818,591, each filed on Jun. 15, 2007. Although not shown, in some embodiments an evacuation pump or device may be used to evacuate fluid from the pouch 50 through, for example, the valve 260 disposed in one of the side walls 52, 54, in or through the closure mechanism 58, or in one of the side edges 56*a-c* of the pouch.

The pouch 50 may include relief on or along an interior surface of one or both of the first and second sidewalls 52, 54 to provide fluid or air flow channels 25, for example as shown in FIG. 1, between the sidewalls when a vacuum, for example, is being drawn through the check valve 260 or through the fluid path 66 disposed at the position 68*b*. In this manner, the pouch 50 provides a complete evacuable system within which items, for example food, may be stored. One or both sidewalls, such as the first sidewall 52, may also be embossed or otherwise textured 125 with a pattern, such as, for example, the diamond pattern shown in FIG. 1, to provide the air flow channels 25 on one or both surfaces spaced between the bottom edge 56*b* and the closure mechanism 58, or a separate textured and embossed patterned wall (not shown) may be used to provide additional flow channels (not shown) within the pouch interior. The flow channels may provide fluid communication between the pouch interior 64 and the valve 260 when fluid is being drawn through the valve 260, or along the fluid path 66 or 166 when fluid is being drawn through the opening 56 or one of the side edges 56*a*-56*c*, respectively. Illustrative flow channels useful in the present invention include those disclosed in Zimmerman et al. U.S. Patent application publication No. 2005/0286808 and Tilman et al. U.S. Patent application publication No 2006/0048483. Other flow channels useful in the present invention include those disclosed in, for example, U.S. patent application Ser. No. 11/818,584, filed on Jun. 15, 2007.

INDUSTRIAL APPLICABILITY

A valve is presented that may be used to evacuate air from a pouch and keep the pouch evacuated, thereby allowing contents of the pouch such as food to remain fresher for extended time periods. In one embodiment, the valve operates by bypassing an occluded closure mechanism that seals a mouth of the pouch. Increased pressure from an interior of the pouch relative to an exterior of the pouch causes the valve to open to allow air to escape from the interior of the pouch. Decreased pressure from the interior the pouch relative to the exterior of the pouch causes the valve to remain closed to prevent air from entering the pouch.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A pouch, comprising:

first and second pouch sidewalls sealed to one another to define an opening;

a resealable closure mechanism attached to inner surfaces of the first and second sidewalls proximate the opening to define a pouch interior opposite the opening;

a channel extending from the interior to the opening through the closure mechanism when the closure mechanism is sealed; and a check valve disposed across the channel between the closure mechanism and the opening, wherein the check valve comprises a first protruding surface on the first sidewall that sealingly engages with a second protruding surface on the second sidewall such that when the closure mechanism is sealed the check valve allows air to be evacuated from the interior through the channel and prevents air from entering the interior through the channel and the protruding surfaces comprise intermeshing complementary first and second corrugated cross sections of the first and second sidewalls.

2. The pouch of claim 1, wherein the resealable closure mechanism comprises at least one interlocking closure profile that includes a textured portion along the length thereof to provide tactile and/or audible sensations when the resealable closure mechanism is occluded.

3. The pouch of claim 1, wherein the channel is proximate a side edge of the pouch.

4. The pouch of claim 1, wherein the check valve comprises a plurality of protruding surfaces disposed on each of the inner surfaces of the first and second sidewalls between the closure mechanism and the opening, and wherein the pluralities of protruding surfaces intermesh when the closure mechanism is sealed to form a substantially continuous interface therebetween.

5. The pouch of claim 1, wherein the fluid path comprises a deformed portion of the closure mechanism.

6. A pouch of claim 5, wherein to closure mechanism comprises first and second closure with interlocking profiles.

7. A pouch comprising:

a first sidewall and a second sidewell sealed together at a first side edge, a second side edge, and a bottom edge extending to the first and second side edges, and defining an opening opposite the bottom edge into an interior between the sidewalls;

a sealed resealable closure mechanism along opposing inner surfaces of the sidewalls extending to the first and second side edges adjacent the opening;

a channel extending through the sealed resealable closure mechanism from the interior to the opening; and a check valve across the channel between the sealed resealable closure mechanism and the opening, wherein the check valve allows air to be evacuated from the interior through the channel and prevents air from entering the interior through the channel, and the check valve comprises a first corrugated surface of the first sidewall intermeshed with a second corrugated surface of the second sidewall.

8. The pouch of claim 7, wherein the check valve comprises a first member on the first sidewell that sealingly engages against the second side wall.

9. The pouch of claim 7, wherein the check valve comprises a first member on the first sidewell that sealingly engages against a second member on the second sidewall.

10. The pouch of claim 9, the first member comprising a first plurality of protruding surfaces, and the second member comprising a second plurality of protruding surfaces, wherein the first plurality of protruding surfaces sealingly intermeshes with the second plurality of protruding surfaces.

11. The pouch of claim 10, wherein the first and second plurality of protruding surfaces form a substantially continuous interface therebetween.

12. The pouch of claim 7, wherein the closure mechanism comprises opposing first and second elongate interlocking profiles.

13. The pouch of claim 12, wherein the channel comprises a deformed portion of at least one of the first second elongate interlocking profiles.

14. The pouch of claim 13, wherein the deformed portion comprises a flattened portion of the respective interlocking profile.

15. The pouch of claim 7, wherein the check valve opens in response to increased pressure in the interior, and wherein the check valve closes in response to decreased pressure in the interior.

* * * * *

UNITED STATES PATENT AND TRADEMARK OFFICE

CERTIFICATE OF CORRECTION

PATENT NO. : 7,967,509 B2
APPLICATION NO. : 11/818592
DATED : June 28, 2011
INVENTOR(S) : Robert R. Turvey et al.

It is certified that error appears in the above-identified patent and that said Letters Patent is hereby corrected as shown below:

Column 11, Line 15: replace “to” with --the--

Column 11, Line 16: insert --elements-- after “closure”

Column 11, Line 18: replace “second sidewell” with --second sidewall--

Column 12, Line 5 Claim 8: replace “first sidewell” with --first sidewall--

Column 12, Line 8 Claim 9: replace “first sidewell” with --first sidewall--

Column 12, Line 22 Claim 13: insert --and-- after “first”

Signed and Sealed this
Fourth Day of October, 2011

David J. Kappos

David J. Kappos
*Director of the United States Patent and Trademark Office*